US010750875B2

(12) United States Patent
Palashewski et al.

(10) Patent No.: US 10,750,875 B2
(45) Date of Patent: Aug. 25, 2020

(54) ADJUSTABLE BED SYSTEM HAVING SPLIT-HEAD AND JOINED FOOT CONFIGURATION

(71) Applicant: Sleep Number Corporation, Minneapolis, MN (US)

(72) Inventors: Wade Daniel Palashewski, Andover, MN (US); Eric Rose, Minneapolis, MN (US); Aran Brosnan, Minneapolis, MN (US)

(73) Assignee: Sleep Number Corporation, Minneapolis, MN (US)

( * ) Notice: Subject to any disclaimer, the term of this patent is extended or adjusted under 35 U.S.C. 154(b) by 601 days.

(21) Appl. No.: 14/146,281

(22) Filed: Jan. 2, 2014

(65) Prior Publication Data

US 2015/0182397 A1 Jul. 2, 2015

(51) Int. Cl.
*A47B 7/02* (2006.01)
*A47C 20/04* (2006.01)
(Continued)

(52) U.S. Cl.
CPC ..... *A47C 20/041* (2013.01); *A47C 20/08* (2013.01); *A47C 27/04* (2013.01); *A47C 27/081* (2013.01);
(Continued)

(58) Field of Classification Search
CPC ..... A47C 21/006; A47C 21/003; A47C 21/04; A47C 21/026; A47C 31/008; A47C 20/08; A47C 20/042; A47C 20/04; A47C 20/041; A47C 27/14; A47C 27/006; A47C 27/04; A47C 27/05; A47C 27/06; A47C 27/15;
(Continued)

(56) References Cited

U.S. PATENT DOCUMENTS 771,076 A * 9/1904 Kintz ..... A61G 7/02 5/604
2,247,516 A 7/1941 Amarantos
(Continued)

FOREIGN PATENT DOCUMENTS

WO WO 2010/149788 12/2010

OTHER PUBLICATIONS

International Search Report and Written Opinion in International Application No. PCT/US2014/072257, dated Apr. 24, 2015, 15 pages.
(Continued)

*Primary Examiner* — Nicholas F Polito
*Assistant Examiner* — Morgan J McClure
(74) *Attorney, Agent, or Firm* — Fish & Richardson P.C.

(57) ABSTRACT

A sleep system comprises a mattress including a movable first section extending laterally along a first portion of a width of the mattress and extending longitudinally along a first portion of a length of the mattress, a movable second section extending laterally along a second portion of the width of the mattress and extending longitudinally along the first portion of the length of the mattress, and a movable third section extending laterally across substantially the entire width of the mattress and extending longitudinally along a second portion of the length of the mattress, and an articulation system configured to independently articulate the first section, the second section, and the third section.

14 Claims, 17 Drawing Sheets

(51) Int. Cl.

| | |
|---|---|
| ***A47C 27/08*** | (2006.01) |
| ***A47C 27/14*** | (2006.01) |
| ***A47C 20/08*** | (2006.01) |
| ***A47C 27/04*** | (2006.01) |
| *A47C 27/05* | (2006.01) |
| *A47C 27/06* | (2006.01) |
| *A47C 19/02* | (2006.01) |

(52) U.S. Cl.
CPC ..... *A47C 27/14* (2013.01); *A47C 19/02* (2013.01); *A47C 27/05* (2013.01); *A47C 27/06* (2013.01)

(58) Field of Classification Search
CPC ..... A47C 27/002; A47C 27/10; A47C 27/125; A47C 27/142; A47C 27/148; A47C 27/20; A47C 27/081; A47C 27/00; A47C 19/025; A47C 19/024; A47C 19/045; A47C 19/005; A47C 19/02; A47C 19/04; A47C 19/122
See application file for complete search history.

(56) References Cited

U.S. PATENT DOCUMENTS 2,689,961 A * 9/1954 Lieberthal ..... A47G 9/023 5/486
2,702,909 A * 3/1955 Atkins ..... A47C 20/043 297/377
2,850,252 A 9/1958 Ford
3,072,776 A * 1/1963 Quenneville ..... H05B 3/342 219/212
3,089,150 A * 5/1963 Briggs ..... A47C 20/041 5/614
3,644,946 A * 2/1972 Swatt ..... A47C 20/041 5/616
3,646,621 A * 3/1972 Fragas ..... A47C 20/04 5/52
3,795,019 A * 3/1974 Fragas ..... A47C 27/001 5/486
3,978,530 A * 9/1976 Amarantos ..... A47C 27/081 5/52
4,893,365 A * 1/1990 Justice ..... A47C 27/001 5/613
4,944,055 A 7/1990 Shainfeld
5,170,522 A 12/1992 Walker
5,315,726 A * 5/1994 Borenstein ..... A47C 19/22 297/161
5,509,154 A 4/1996 Shafer et al.
5,537,701 A * 7/1996 Elliott ..... A47C 19/005 5/616
5,564,140 A 10/1996 Shoenhair et al.
5,642,546 A 6/1997 Shoenhair
5,652,484 A 7/1997 Shafer et al.
5,765,246 A 6/1998 Shoenhair
5,870,784 A 2/1999 Elliott
5,903,941 A 5/1999 Shafer et al.
5,904,172 A 5/1999 Gifft et al.
5,916,086 A 6/1999 Rossdeutscher
6,008,598 A * 12/1999 Luff ..... A47C 31/008 318/16
6,037,723 A 3/2000 Shafer et al.
6,108,844 A 8/2000 Kraft et al.
6,161,231 A 12/2000 Kraft et al.
6,202,239 B1 3/2001 Ward et al.
6,311,347 B1 * 11/2001 Limardi ..... A47G 9/0223 5/482
6,397,419 B1 6/2002 Mechache
6,483,264 B1 11/2002 Shafer et al.
6,686,711 B2 2/2004 Rose et al.
6,698,043 B2 * 3/2004 Fabian ..... A47G 9/0238 5/482
6,708,357 B2 3/2004 Gaboury et al.
6,763,541 B2 7/2004 Mahoney et al.
6,804,848 B1 10/2004 Rose
6,832,397 B2 12/2004 Gaboury et al.
6,862,760 B2 3/2005 Bradley et al.
6,883,191 B2 5/2005 Gaboury et al.
7,017,210 B2 * 3/2006 Ooyama ..... A61G 7/015 5/613
7,389,554 B1 6/2008 Rose
7,865,988 B2 1/2011 Koughan et al.
8,117,693 B1 * 2/2012 Helton ..... A47G 9/023 5/482
8,266,746 B2 * 9/2012 Oh ..... A47C 20/041 5/617
8,336,369 B2 12/2012 Mahoney
8,444,558 B2 5/2013 Young et al.
D687,210 S * 8/2013 Krafnick ..... D2/720
8,672,853 B2 3/2014 Young
8,769,747 B2 7/2014 Mahoney et al.
2003/0195644 A1 10/2003 Borders et al.
2003/0217411 A1 * 11/2003 Bradley ..... A47G 9/023 5/486
2006/0031987 A1 * 2/2006 Stanfield ..... A47G 9/0207 5/486
2008/0262657 A1 * 10/2008 Howell ..... A47C 20/041 700/275
2010/0174198 A1 7/2010 Young et al.
2011/0306844 A1 12/2011 Young
2012/0138067 A1 * 6/2012 Rawls-Meehan .... A47C 20/041 128/845
2013/0014326 A1 * 1/2013 Kane ..... A47G 9/02 5/482
2013/0289770 A1 * 10/2013 Rawls-Meehan ..... G05B 15/02 700/275
2014/0007656 A1 1/2014 Mahoney
2014/0137332 A1 5/2014 McGuire et al.
2014/0182061 A1 7/2014 Zaiss
2014/0259419 A1 9/2014 Stusynski
2015/0328070 A1 * 11/2015 Tarplee ..... A47C 20/08 5/616
2016/0120740 A1 * 5/2016 Rawls-Meehan ..... A61H 23/0263 601/49

OTHER PUBLICATIONS

U.S. Appl. No. 14/588,606, filed Jan. 2, 2015, Palashewski et al.
U.S. Appl. No. 14/146,327, filed Jan. 2, 2014, Palashewski et al.
U.S. Appl. No. 13/933,285, filed Jul. 2, 2013, Palashewski.
Supplementary European Search Report in U.S. Appl. No. 14/876,749, dated Aug. 21, 2017, 4 pages.

* cited by examiner

ADJUSTABLE BED SYSTEM HAVING SPLIT-HEAD AND JOINED FOOT CONFIGURATION

BACKGROUND

Beds can also be designed to be movable or adjustable to positions other than a traditional flat, horizontal support surface. For example, the bed can include one or more articulable sections that can be raised and lowered, for example to adjust a position of the user's head and upper torso or to adjust a position of the user's legs, or both. In beds designed for two users, such as queen-sized or king-sized beds, the bed can be configured to be adjustable as well. However, typically an adjustable two-person bed must either be a single mattress wherein both sides of the bed must be adjusted the same way or two separate adjustable mattresses positioned proximate to each other.

The single-mattress adjustable design can be undesirable because it may not allow for individual control of each side of the bed, and thus cannot accommodate the positional preferences of both users of a two-person bed at the same time. The separate-mattress adjustable design can provide for individual positional control of each side of the bed, but is aesthetically unpleasing, e.g., for a married couple, because it resembles a pair of twin beds that have been pushed together. The separate-mattress adjustable design can also have functional issues due to the presence of the gap between the two separate mattresses that runs laterally along the middle of the bed, such as limited support for the bed users along the gap.

SUMMARY

The present disclosure is directed to a sleep system sized and configured for use by two people, such as a queen-sized or king-sized bed, that can provide for individual adjustability of each side of the bed, while still providing at least a portion of the bed that functions as a single, unitary mattress. The sleep system can include a mattress where at least one portion of the bed is longitudinally split between each side of the bed so that the split portion of each side can be adjusted independently of the split portion of the other side. The mattress also includes a second portion that is joined together across substantially the entire width of the bed, such as the longitudinal middle of the bed, to provide the aesthetic appeal of a single mattress and to provide sufficient support to users of the sleep system along a longitudinal middle axis of the mattress. The sleep system described herein can include, for example, a split upper portion of the mattress allowing for individual control of an upper area of the users' bodies, e.g., the head and upper torso, and a common joined lower portion of the mattress, e.g., to provide for substantially complete support of the users' trunk or middle torso, and legs.

In an example a sleep system comprises a mattress comprising a first sleep area for a first occupant, the first sleep area comprising a first movable upper section and a first movable lower section, a second sleep area for a second occupant, the second sleep area comprising a second movable upper section adjacent to the first movable upper section and a second movable lower section adjacent to the first lower section, wherein the first movable upper section is separate from and movable with respect to the second movable upper section, wherein the first movable lower section and the second movable lower section are coupled together and move together, and an articulation system for articulating the first movable upper section, the first movable lower section, the second movable upper section, and the second movable lower section, wherein the articulation system is configured to allow for independent movement of the first upper movable section and the second upper movable section and for substantially synchronized movement of the first lower movable section and the second lower movable section.

In another example a sleep system comprises a mattress including a movable first section extending laterally along a first portion of a width of the mattress and extending longitudinally along a first portion of a length of the mattress, a movable second section extending laterally along a second portion of the width of the mattress and extending longitudinally along the first portion of the length of the mattress, and a movable third section extending laterally across substantially the entire width of the mattress and extending longitudinally along a second portion of the length of the mattress, and an articulation system configured to independently articulate the first section, the second section, and the third section.

In yet another example, a sleep system comprises a support frame, a mattress configured to be positioned on the support frame, the mattress including a movable first head section extending along a first portion of a length of the mattress, a movable second head section laterally adjacent to the movable first section and extending longitudinally along the first portion of the length of the mattress, and a movable leg section extending longitudinally along a second portion of the length of the mattress, wherein a first sleep area for a first occupant comprises the movable first head section and a first portion of the movable leg section, and wherein a second sleep area for a second occupant comprises the movable second head section and a second portion of the movable leg section, an articulation system including a first head actuator for articulating the movable first head section, a second head actuator for articulating the movable second head section, at least one leg actuator for articulating the movable leg section, and at least one controller for controlling the first head actuator, the second head actuator, and the at least one leg actuator, a first user controlling device configured to communicate with the at least one controller via a first communication link in order to control articulation of the movable first head section and to control articulation of the movable leg section, and a second user controlling device configured to communicate with the at least one controller via a second communication link in order to control articulation of the movable second head section and to control articulation of the movable leg section.

In an example a method for controlling an articulating bed comprises sending a first movement control signal from a first user controlling device to one or more controllers, wherein the first movement control signal comprises one or more commands to move a movable first section of a mattress to a selected one of a plurality of positions, wherein the movable first section laterally extends across a first portion of a width of the mattress and longitudinally extends along a first portion of a length of the mattress, sending a first actuator control signal, triggered by the first movement control signal, from the one or more controllers to a first articulating actuator, moving the first movable section to the selected one of the plurality of positions of the first movable section according to the first actuator control signal with the first articulating actuator, sending a second movement control signal from a second user controlling device to the one or more controllers, wherein the second movement control signal comprises one or more commands to move a second movable section of the mattress to a selected one of a plurality of positions of the second movable section, wherein the second movable section is laterally adjacent to the first movable section and laterally extends across a second portion of the width of the mattress and longitudinally extends along the first portion of the length of the mattress, sending a second actuator control signal, triggered by the second movement control signal, from the one or more controllers to a second articulating actuator, moving the second movable section to the selected one of the plurality of positions of the second movable section according to the second actuator control signal with the second articulating actuator, sending a third movement control signal from one of the first user controlling device and the second user controlling device to the one or more controllers, wherein the third movement control signal comprises one or more commands to move a third movable section of the mattress to a selected one of a plurality of positions, wherein the third movable section longitudinally extends along a second portion of the length of the mattress, sending a third actuator control signal, triggered by the third movement control signal, from the one or more controllers to a third articulating actuator configured to exert force at a first position of the movable third section, sending a fourth actuator control signal, triggered by the third movement control signal, from the one or more controllers to a fourth articulating actuator configured to exert force at a second position of the movable third section, and moving the third movable section to the selected one of the plurality of positions, wherein the third actuator control signal and the fourth actuator control signal are configured so that movement of the third articulating actuator and movement of the fourth articulating actuator are substantially synchronized so that movement of the third movable section is substantially uniform across the width of the mattress.

These and other examples and features of the present systems and methods will be set forth in part in the following Detailed Description. This Summary is intended to provide an overview of the present subject matter, and is not intended to provide an exclusive or exhaustive explanation. The Detailed Description below is included to provide further information about the present systems and methods.

DETAILED DESCRIPTION

This disclosure describes a sleep system including an adjustable bed configured for two occupants to share. The adjustable bed can be configured so that at least a first portion of each side (e.g., left side and right side) of the bed can be independently adjusted by the occupant of each particular side of the bed, e.g., so that each occupant can select a particular position or positions that he or she prefers, while a second portion of each side is joined together with a corresponding portion of the other side of the bed. The adjustability of the first portion of each side and the joined nature of the second portion can allow for a user to independently control the position of the first portion his or her side of the bed and can provide for a unitary mattress at the second portion of the bed, which can provide for better joint support across both sides of the bed.

Figure 1:
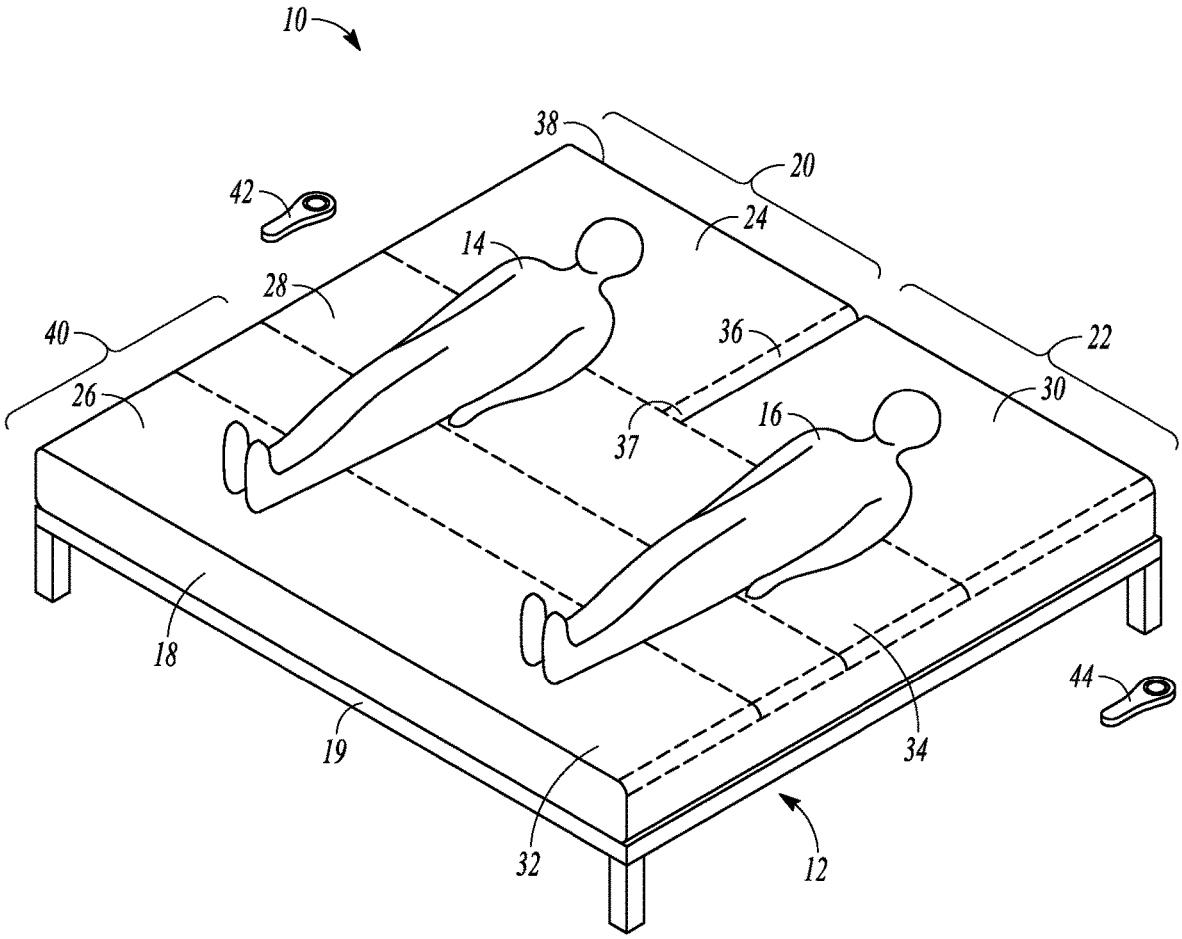
FIG. 1 is a perspective view of an example two-person sleep system including an adjustable bed having a split upper portion and a joined lower portion shown with both sides of the bed being in a horizontal or flat position.
Figure 2:
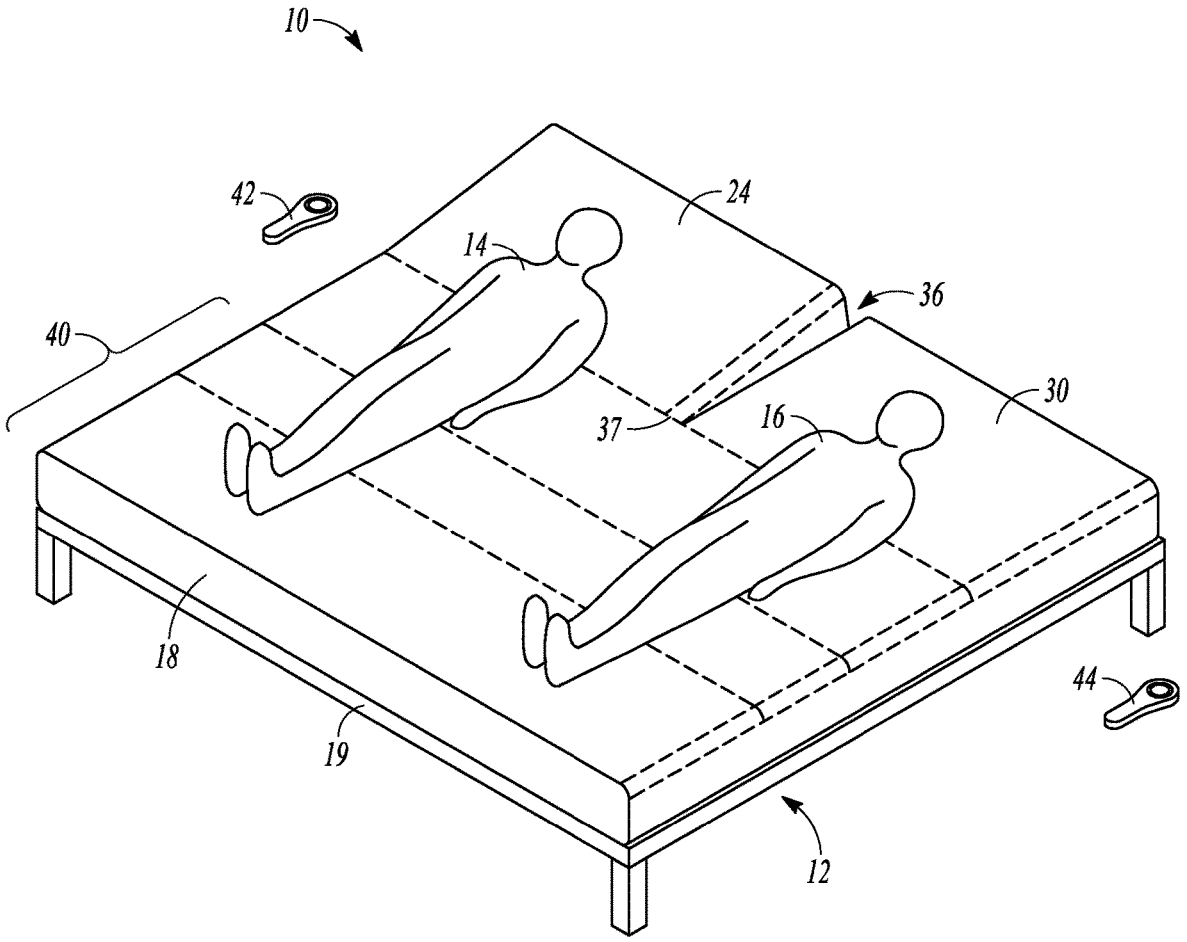
FIG. 2 is a perspective view of the example sleep system of FIG. 1 with a head portion of one of the sides of the bed being raised.

FIGS. 1 and 2 show a perspective view of an example sleep system 10. The sleep system 10 can include a bed 12 that is configured and intended to be used by two occupants, a first occupant 14 and a second occupant 16. The bed 12 can include a mattress 18 supported by a frame 19. The bed 12 can be conceptually divided into a first sleep area 20 for the first occupant 14 located on a first side of the bed 12 (e.g., the left side in FIGS. 1 and 2) and a second sleep area 22 for the second occupant 16 on a second side of the bed 12 (e.g., the right side in FIGS. 1 and 2).

At least a portion of each of the sleep areas 20, 22 can be movable or articulable between a plurality of positions to provide the occupants 14, 16 with the ability to select a preferred position for comfort of for a particular purpose. Each sleep area 20, 22 can include one or more articulable sections. In an example, the first sleep area 20 can include a section 24 that can be raised and lowered to adjust a position of the head or upper torso, or both, of the first occupant 14 (referred to herein as the first head section 24), a section 26 that can be raised and lowered to adjust a position of the legs or lower torso, or both, of the first occupant 14 (referred to herein as the first leg section 26), and a section 28 positioned longitudinally between the first head section 24 and the first leg section 26 (referred to herein as the first middle section 28). Similarly, the second sleep area 22 can include a section 30 that can be raised and lowered to adjust a position of the head or upper torso, or both, of the second occupant 16 (referred to herein as the second head section 30) that is adjacent to the first head section 24; a section 32 that can be raised and lowered to adjust a position of the legs or lower torso, or both, of the second occupant 16 (referred to herein as the second leg section 32) that is adjacent to the first leg section 26; and a section 34 positioned longitudinally between the second head section 30 and the second leg section 32 (referred to herein as the second middle section 34) that is adjacent to the first middle section 28. The middle sections 28, 34 can be configured to support the trunk area of the occupants 14, 16 (e.g., the middle torso around the waist and a portion of the upper legs), and can be configured to be movable (e.g., raised and lowered) or can be configured to be stationary and to remain in the same position and orientation throughout operation of the bed, depending on the desired operability of the bed 12.

As shown in FIGS. 1 and 2, the mattress 18 can be configured so that a first portion of the first sleep area 20 is independently articulable from a corresponding adjacent first portion of the second sleep area 22, and vice versa, so that the first portion of the second sleep area 22 is independently articulable from the corresponding first portion of the first sleep area 20. In the example shown in FIGS. 1 and 2, the first head section 24 and the second head section 30 are adjacent to one another and can be articulated upward or downward independent of one another. The independent articulation of the head sections 24, 30 can be provided for by a medial split 36 extending longitudinally from an upper end 38 of the mattress 18. As described in more detail below, each of the head sections 24, 30 can be articulated with one or more actuators, such as one or more articulable motors so that each head section 24, 30 is an independently movable section of the mattress 18.

The mattress 18 can also be configured so that a second portion of the first sleep area 20 and a corresponding second portion of the second sleep area 22 are coupled together and configured to be moved together in a substantially synchronized manner. For example, as shown in the mattress 18 of FIGS. 1 and 2, the middle sections 28, 34 are joined together as a substantially unitary middle section and the leg sections 24, 32 are joined together as a substantially unitary leg section so that the sections 24, 28, 32, 34 together resemble a single joined lower section 40 of the mattress 18. As described in more detail below, one or both of the leg sections 26, 32 and the middle sections 28, 34 of each sleep area 20, 22 can be articulated with one or more actuators, such as one or more articulable motors so that the sections 24, 28, 32, 34 can act together as a single movable joined lower section 40.

Figure 4:
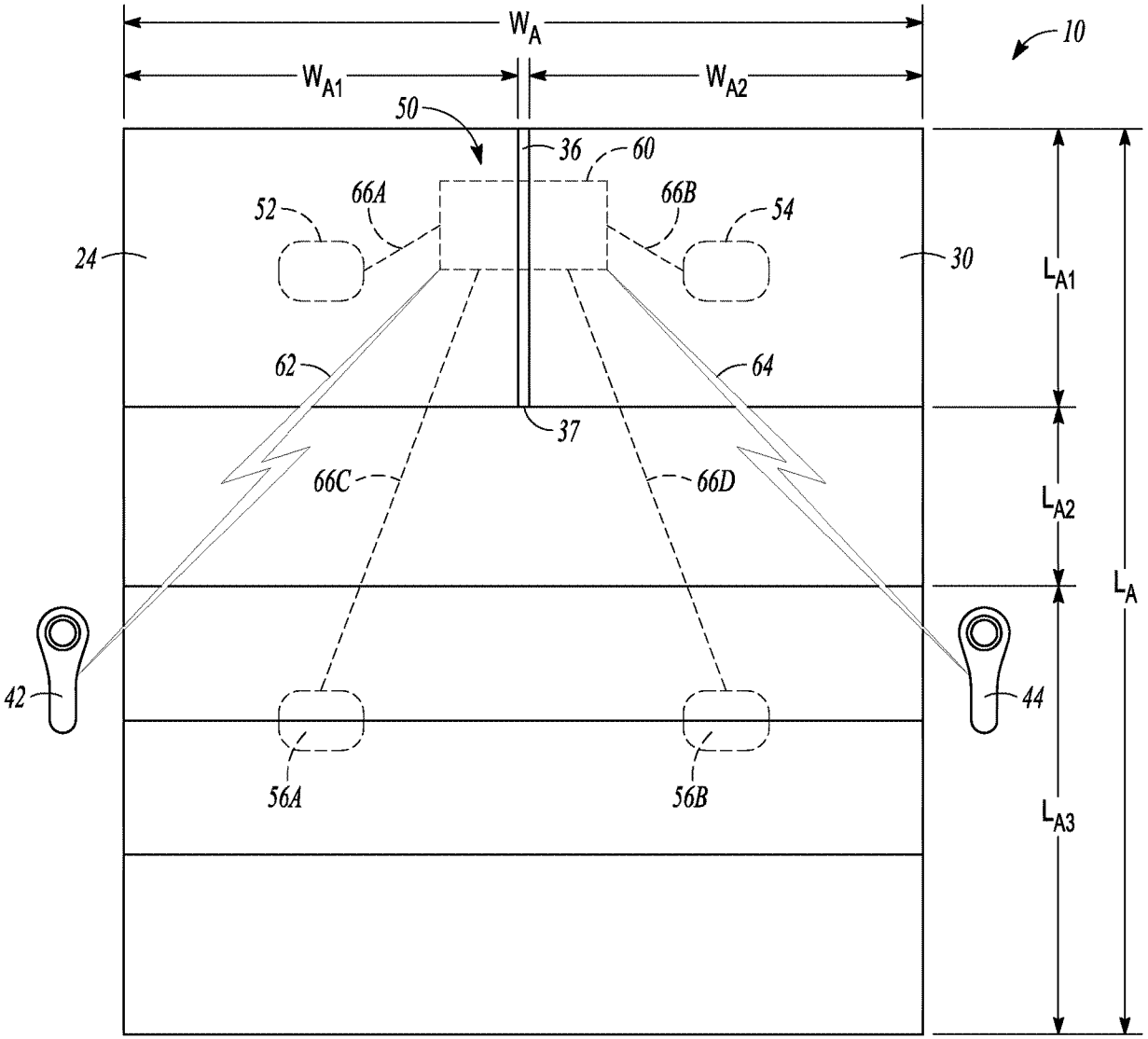
FIG. 4 is a top view of the example sleep system of FIGS. 1-3.

As best seen in FIG. 4, the mattress 18 can comprise a movable first section (e.g., the first head section 24) extending laterally along a first portion $W_{A1}$ of the total width $W_A$ of the mattress 18 and extending longitudinally along a first portion $L_{A1}$ of the total length $L_A$ of the mattress 18. Similarly, the mattress 18 can comprise a movable second section (e.g., the second head section 30) extending laterally along a second portion $W_{A2}$ of the width $W_A$ of the mattress 18 and extending longitudinally along the same first portion $L_{A1}$ of the length $L_A$ of the mattress as the first movable section (e.g., the first head section 24). The mattress 18 can also comprise a movable third section (e.g., the joined lower section 40 formed by the joined and substantially unitary first leg section 26, second leg section 32, first middle section 28, and second middle section 34) extending laterally across substantially the entire width $W_A$ of the mattress 18 and extending longitudinally along a second portion $L_{A2}$ of the length $L_A$ of the mattress 18

Figure 3:
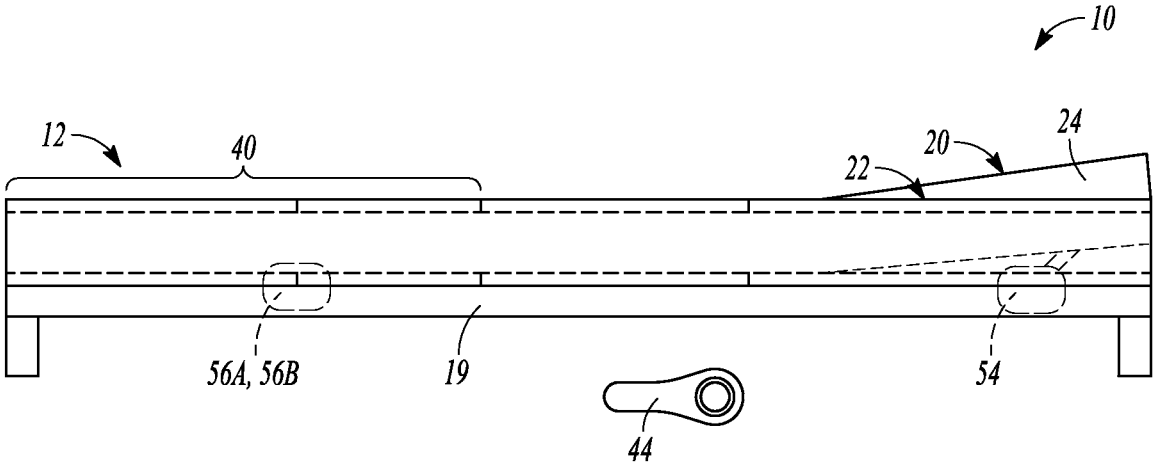
FIG. 3 is a side view of the example sleep system of FIGS. 1 and 2, shown with a head portion of one of the sides of the bed being raised.

FIGS. 2 and 3 show a perspective view and a side view, respectively, of an example configuration of the bed 12 wherein the first sleep area 20 is in a first configuration while the second sleep area 22 is in a second configuration. For example, as shown in FIGS. 2 and 3, the first sleep area 20 includes the first portion (e.g., the portion of the first sleep area 20 that is independently movable relative to a corresponding first section of the second sleep area 22) being articulated relative to the rest of the first sleep area 20. The example shown in FIGS. 2 and 3 show the first head section 24 being elevated relative to the horizontal position (FIG. 1). In the example shown in FIGS. 2 and 3, the second sleep area 22 is in a flat configuration with the second head section 30, the second middle section 34, and the second leg section 32 being in a horizontal or substantially horizontal orientation. Thus, the second sleep area 22 is in the same or substantially the same configuration in FIGS. 2 and 3 as it is in FIG. 1.

The sleep system 10 can also include a pair of user controlling devices 42, 44 to allow each occupant 14, 16 to control the articulation of his or her respective sleep area 20, 22. As shown in FIGS. 1-3, the sleep system 10 can include a first user controlling device 42, e.g., a first handheld remote control 42, that has been programmed to control operation of the first sleep area 20, and a second user control device 44, e.g., a second handheld remote control 44, that has been programmed to control operation of the second sleep area 22. The first occupant 14 can use the first remote control 42 to control operation of the first sleep area 20, upon which the first occupant 14 is lying, and the second occupant 16 can use the second remote control 44 to control operation of the second sleep area 22 upon which the second occupant 16 is lying. In order to ensure proper linking between each remote control 42, 44 and the corresponding sleep area 20, 22, each remote control 42, 44 can include an address or other unique identifier, for example to distinguish the first remote control 42 from the second remote control 44.

In an example, the first occupant 14 can select, via the first remote control 42, to control articulation of the first head section 24 upward or downward by a certain amount. The first remote control 42 can also be configured to control articulation of the joined lower section 40 (e.g., to control articulation of one or both of the joined leg sections 26, 32 and the joined middle sections 28, 34), for example to move the leg sections 26, 32 upward or downward by a certain amount. The second occupant 16 can select, via the second remote control 44, to control articulation of the second head section 30 upward or downward by a certain amount. The second remote control 44 can also be configured to control articulation of the joined lower section 40 (e.g., to control articulation of one or both of the joined leg sections 26, 32 and the joined middle sections 28, 34). In an example, articulation of the joined lower section 40 can be controlled by only the first remote control 42, by only the second remote control 44, or by both the first remote control 42 and the second remote control 44.

In an example, articulation of the head sections 24, 28 or the joined lower section 40, or both, can be controlled to occur continuously or along a discrete set of positions between a minimum height or orientation and a maximum height or orientation. For example, the head section 24, 28 and the joined lower section 40 can be articulable from a minimum height position (e.g., flat) to a maximum height position (e.g., with the head section 24, 28 at a maximum angle with respect horizontal, such as about 60°, or with the leg section 26, 32 forming a maximum angle with respect to horizontal, such as about 45°).

The sleep system 10 can also be configured so that each sleep area 20, 22 can be positioned into one or more predetermined or preset positions. For each preset position, the head section 24, 28 (and in some cases, the joined lower section 40) can be moved to predetermined positions or orientations. Examples of preset positions that can each be programmed into the sleep system 10 include, but are not limited to:

(a) a flat preset, e.g., with the head section 24, 28 and the joined lower section 40 being in a horizontal or substantially horizontal orientation;

(b) a "reading" preset, e.g., with the head section 24, 28 being at an elevated or angled position relative to horizontal to allow the occupant 14, 16 to read a book, magazine, or other written material. A reading preset can also include elevating a portion of the joined lower section 40 to make reading more comfortable for the occupant 14, 16;

(c) a "television" preset, e.g., with the head section 24, 28 being elevated or angled relative to horizontal at a different angle relative to the "reading" preset, to allow the occupant 14, 16 to comfortably watch television. The television preset can also include elevating a portion of the joined lower section 40 to make viewing more comfortable for the occupant 14, 16; and (d) a "snore" present, e.g., a position to reduce snoring by the occupant 14, 16. It has been found that, in some cases, snoring can be reduced or prevented by elevating the snorer's head or torso by a small amount, which can reduce vibration of soft tissue in the back of the mouth or the throat of a user when the soft tissue becomes relaxed during sleep. The slight elevation of the snorer's body can also induce the snorer to change his or her sleeping position, which can cause the snoring to stop. In an example, the "snore preset" can be configured to elevate the head section 24, 28 from horizontal by a small angle of from about 5° to about 15° from horizontal, such as about 7°.

FIG. 4 shows a top view of the sleep system 10. As shown in FIG. 4, the sleep system 10 can include an a reticulation system 50 for controlling articulation of the articulable sections 24, 30, 40. The articulation system 50 can include a set of articulating actuators, with each articulable section being articulated by one or more of the actuators. An example of an actuator that can be used for articulating the articulable sections 24, 30, 40 can include one or more motors. For example, a first head motor 52 can be configured to articulate the first head section 24 of the first sleep area 20 and a second head motor 54 can be configured to articulate the second head section 30 of the second sleep area 22. One or more leg motors can be configured to articulate the joined lower section 40. For example, as shown in FIG. 4, the joined lower section 40 can be articulated by a first leg motor 56A on a first side of the mattress 18 (e.g., to articulate the first leg section 26 on the side of the first sleep area 20) and a second leg motor 56B on a second side of the mattress 18 (e.g., to articulate the second leg section on the side of the second sleep area 22).

As described in more detail below, the articulation system 50 can be configured to control the one or more leg motors 56A, 56B so that the articulation of the joined lower section 40 is substantially uniform. The term "substantially uniform," as used herein, can refer to the joined lower section 40 articulating so that a reference line extending laterally across the joined lower section 40 will remain substantially horizontally level (e.g., substantially parallel to the surface upon which the sleep system 10 is resting) as the lower section 40 is articulated upward or downward. In an example, the articulation system 50 can be configured to control the one or more leg motors 56A, 56B so that the articulation of the first leg section 26 and the second leg section 32 is substantially synchronized. The term "substantially synchronized," as used herein, can refer to each point on the first leg section 26 being at substantially the same vertical position as a corresponding point on the second leg section 32 at substantially the same time, and in an example, so that the height of the first leg section 26 and the second leg section 32 are substantially uniform. In an example, "substantially synchronized" can refer to each point of a first movable section is at the same vertical position as a corresponding point of the substantially synchronized second movable section so that a horizontal line extending laterally across the substantially synchronized sections is substantially horizontally level during articulation of the sections, e.g., so that the horizontal line is substantially parallel to the surface upon which the sleep system is resting. "Substantially synchronized" can also refer to the actuator or actuators that articulate the substantially synchronized sections can be configured to move substantially the same amount over substantially the same period of time so that the sections that are substantially synchronized seem to move as a single piece.

The mattress 18 can include one or more supporting structures for supporting the occupants 14, 16 within the movable first section (e.g., the first head section 24), the movable second section (e.g., the second head section 30), and a joined third section (e.g., the joined lower section 40). In an example, the mattress 18 can include a set of one or more supporting structures, such as one or more first air chambers, for the first sleep area 20, for example, carried in a case the forms the first movable section (e.g., the first head section 24) and a first portion of the third section (e.g., the portion of the joined lower section 40 that makes up part of the first sleep area 20). The mattress 18 can also comprise one or more second supporting structures, such as one or more second air chambers, for the second sleep area 22, for example, carried in the portions of the case that forms the second movable section (e.g., the second head section 30) and a second portion of the third section (e.g., the portion of the joined lower section 40 that makes up part of the second sleep area 22).

The articulation system 50 can also include one or more controllers, such as a control box that includes the electronics and hardware for providing instructions to the articulating motors 52, 54, 56A, 56B. FIG. 4 is a top view of the example sleep system 10, showing the articulation system 50 including a single, common controller 60 that is configured to control each of the sleep areas 20, 22, e.g., each of the articulating motors 52, 54, 56A, 56B. Each remote control 42, 44 can be in communication with the controller 60, such as via a wireless communication link 62, 64. The remote controls 42, 44 can send movement control signals to the controller 60 via the communication links 62, 64. A "movement control signal," as used herein, can refer to a signal or plurality of signals sent from a remote control 42, 44 to the controller 60 corresponding to a particular movement or position of one or more of the articulable sections 24, 30, 40. A movement control signal can include one or more instructions for the direction of movement of a particular articulable section 24, 30, 40, e.g., the direction of movement of a corresponding articulating motor 52, 54, 56A, 56B, a speed for the movement of a particular articulable section 24, 30, 40 or of a particular articulating motor 52, 54, 56A, 56B, or an overall position of the corresponding sleep area 20, 22 being controlled by the remote control 42, 44, such as a preset position.

The controller 60 can send one or more motor control signals to one or more of the articulating motors 52, 54, 56A, 56B corresponding to a desired motion of each articulating motor 52, 54, 56A, 56B. A "motor control signal," as used herein, can refer to a signal or plurality of signals sent from a controller, such as the controller 60, to one or more articulating motors 52, 54, 56A, 56B corresponding to a particular movement or position of one or more articulable sections 24, 30, 40. A motor control signal or signals can comprise an instruction for one or both of the direction that each articulating motor 52, 54, 56A, 56B should articulate and the speed at which the articulating motor 52, 54, 56A, 56B should travel. In an example, a plurality of communication cables 66A, 66B, 66C, and 66D (collectively referred to herein as "cable 66" or "cables 66") can carry the motor control signals from the controller 60 to the articulating motors 52, 54, 56A, 56B, with each cable 66 corresponding to a particular motor (such as a first cable 66A for the first head motor 52, a second cable 66B for the second head motor 54, a third cable 66C for one leg motor 56A, and a fourth cable 66D for the other leg motor 56B).

In another example, a sleep system 70 can include an articulating system 72 having more than a single common controller. In the example shown in FIG. 5, each sleep area 20, 22 can have its own controller, such as a first controller 74A corresponding to the upper or head portion of the mattress 18, e.g., by being configured to control the first head motor 52 and the second head motor 54, and a second controller 74B corresponding to the lower or leg portion of the mattress 18, e.g., by being configured to control the leg motors 56A, 56B. In such an example, each remote control 42, 44 can be linked to both controllers 74A, 74B via one or more wireless communication links 62, 64 and each controller 74A, 74B can be configured to respond to commands sent from both remote controls 42, 44, depending on which remote control 42, 44 is sending the command.

If, for example, the first occupant 14 wishes to articulate his or her head and upper torso upward or downward, he or she can make a selection on the first remote control 42 that can instigate the transmission of a movement control signal from the first remote control 42 via wireless communication link 62A to the first controller 74A, which in turn can send a motor control signal to the first head motor 52. Similarly, if the first occupant 14 wishes to articulate his or her feet, he or she can make a selection on the first remote control 42 that can instigate the transmission of a movement control signal via the wireless communication link 62B to the second controller 74B, which in turn can send a motor control signal to the leg motors 56A, 56B. If, for example, the second occupant 16 wishes to articulate his or her head and upper torso upward or downward, he or she can make a selection on the second remote control 44 that can instigate the transmission of a movement control signal from the second remote control 44 via wireless communication link 64A to the first controller 74A, which in turn can send a motor control signal to the second head motor 54. Similarly, if the second occupant 16 wishes to articulate his or her feet, he or she can make a selection on the second remote control 44 that can instigate the transmission of a movement control signal via the wireless communication link 64B to the second controller 74B, which in turn can send a motor control signal to the leg motors 56A, 56B.

Figure 6:
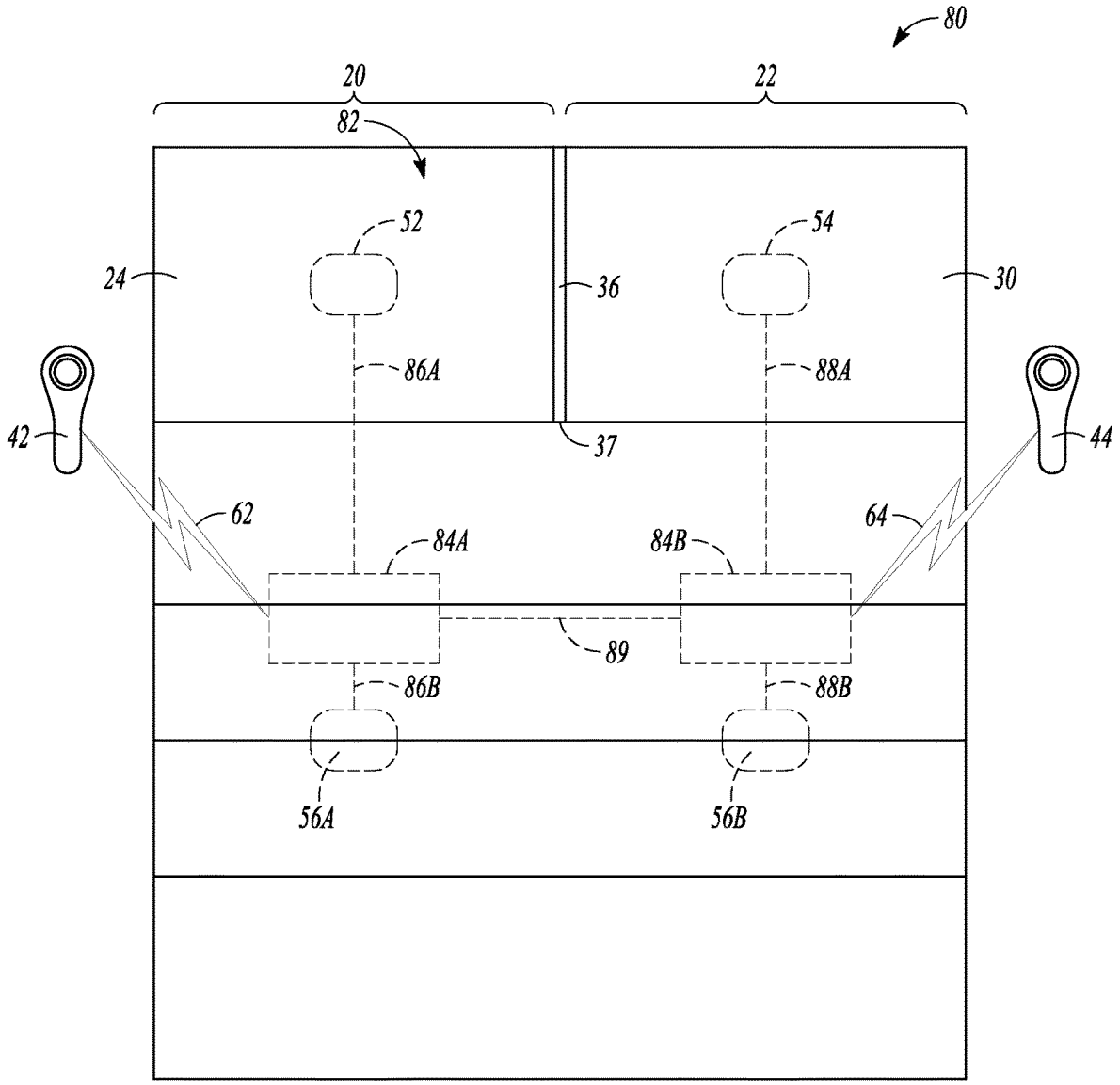
FIG. 6 is a top view of another example two-person sleep system including an adjustable bed having a split upper portion and a joined lower portion.

In another example sleep system 80 shown in FIG. 6, each of the separate controllers 84A, 84B can be linked to a corresponding remote control 42, 44, and each controller can be configured to control a corresponding one of the sleep areas 20, 22. For example, a first of the separate controllers 84A can be configured to control the positioning of the first sleep area 20 by controlling the first head motor 52 and a first leg motor 56A. A second controller 84B can be configured to control positioning of the second sleep area 22 by controlling the second head motor 54 and a second leg motor 56B. In such an example, each controller 84A, 84B can be configured to respond to commands sent from only one of the remote controls 42, 44, such as the first controller 84A being linked to the first remote control 42 via a first wireless communication link 62 and the second controller 84B being linked to the second remote control 44 via a second wireless communication link 64 each remote control 42, 44 can send movement control signals to a corresponding controller 84A, 84B, similar to the transmission of movement control signals described above with respect to a single controller 60.

Figure 5:
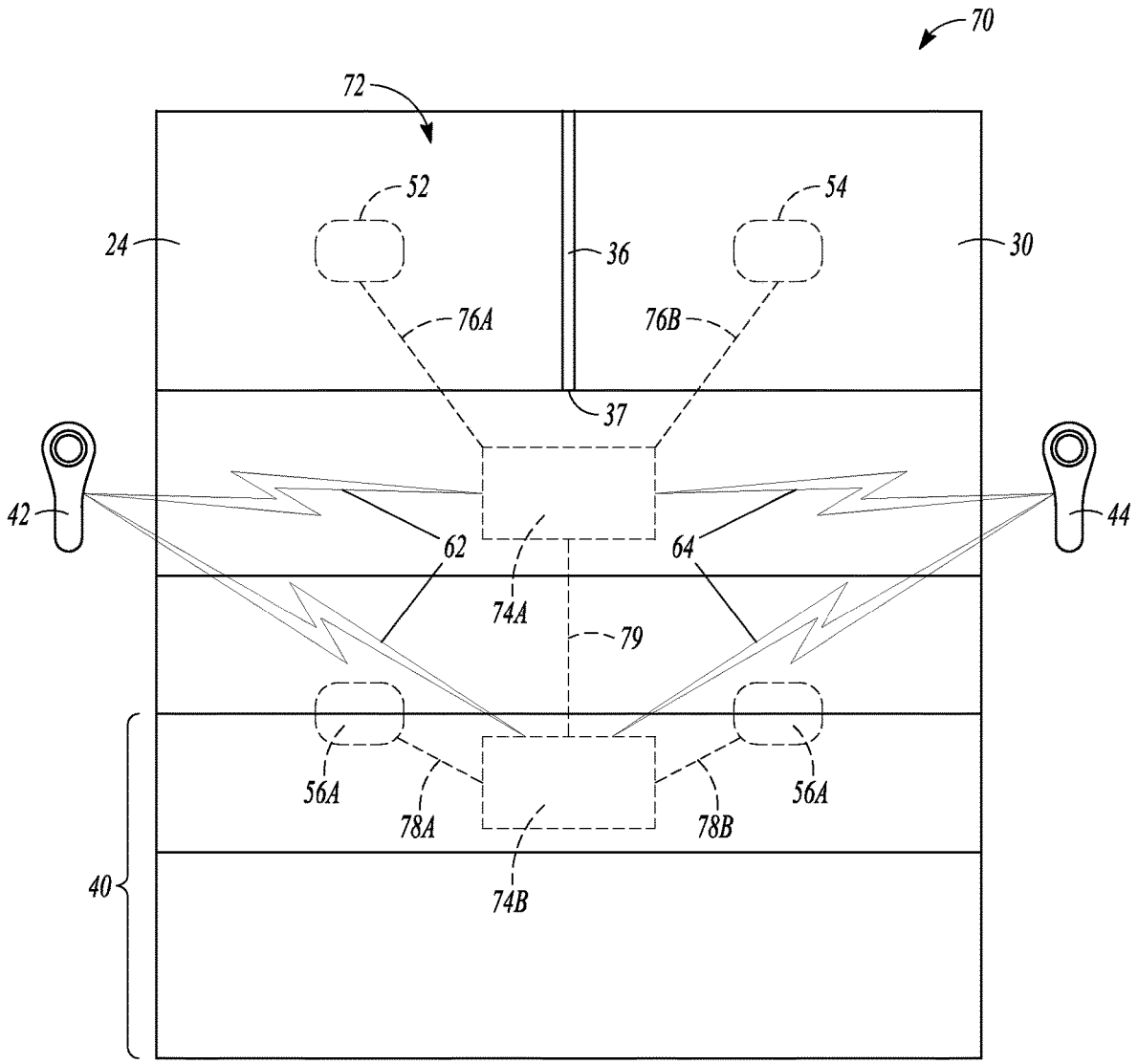
FIG. 5 is a top view of another example two-person sleep system including an adjustable bed having a split upper portion and a joined lower portion.

In the example sleep system 70 shown in FIG. 5, each separate controller 74A, 74B (collectively referred to herein as "controller 74" or "controllers 74") can include communication links, such as cables, to the articulating motors 52, 54, 56A, 56B that are controlled by that particular controller 74. For example, the first controller 74A can be linked to the first head motor 52 via a first cable 76A and to the second head motor 54 via a second cable 76B. Similarly, the second controller 74B can be linked to the first leg motor 56A via a first cable 78A and to the second leg motor 56B via a second cable 78B. The controllers 74A and 74B can be in communication with each other via a communication link, such as a cable 79 running between the controllers 74A, 74B to pass control signals between the controllers 74A, 74B.

In the example sleep system 80 shown in FIG. 6, each separate controller 84A, 84B (collectively referred to herein as "controller 84" or "controllers 84") can include communication links, such as cables, to the articulating motors 52, 54, 56A, 56B that are controlled by that particular controller 84. For example, the first controller 84A can be linked to the first head motor 52 via a first cable 86A and to the first leg motor 56A via a second cable 86B. Similarly, the second controller 84B can be linked to the second head motor 54 via a first cable 88A and to the second leg motor 56B via a second cable 88B. The controllers 84A and 84B can be in communication with each other via a communication link, such as a cable 89 running between the controllers 84A, 84B to pass control signals between the controllers 84A, 84B.

In examples where the supporting structures of the mattress 18 comprise air chambers, the sleep system 10, 70, 80 can also comprise an inflation system configured to control the pressure within the air chambers. The inflation system can comprise one or more pumps configured to inflate or deflate the air chambers, and one or more controllers configured to control the one or more pumps. In an example, the one or more controllers that control articulation of the mattress 18 (e.g., the single controller 60 or the plurality of controllers 74A, 74B or controllers 84A, 84B) can also be configured to control operation of the one or more pumps. In another example, one or more separate controllers for controlling operation of the one or more inflation pumps can be provided that are separate from the one or more controllers for controlling articulation of the mattress 18.

In an example, the inflation system can provide for individual control of the air pressure within each air chamber or within one or more sets of air chambers. For example, if a first set of one or more air chambers is located in the first sleep area 20 and a second set of one or more air chambers is located in the second sleep area 22, then the inflation system can be configured to individually control the pressure in the first set of air chambers in order to control the firmness of one or more portions or the entirety of the first sleep area 20 and the inflation system can be configured to individually control the pressure in the second set of air chambers in order to control the firmness of one or more portions or the entirety of the second sleep area 22. In an example, the user controlling devices 42, 44 can also be configured to control the inflation system, such as by communicating with the controllers of the inflation system to control the pump. Each user controlling device 42, 44 can be configured to control inflation of the air chambers associated with a corresponding one of the sleep areas 20, 22, e.g., so that the first occupant 14 can control the firmness of the first sleep area 20 and the second occupant 16 can control the firmness of the second sleep area 22.

Figure 7A:
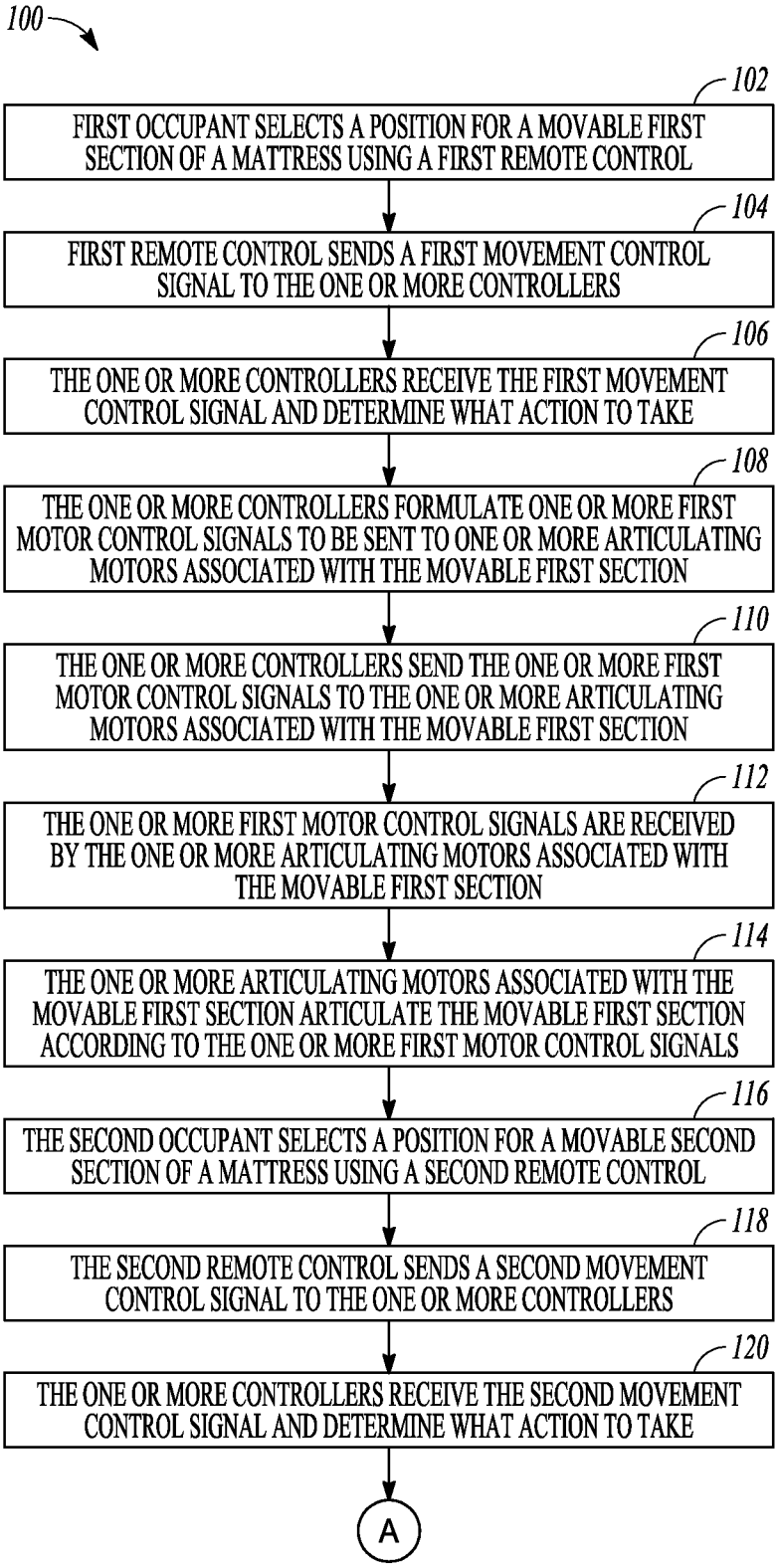
FIGS. 7A-7C are a flow diagram of an example method for controlling a sleep system.
Figure 7B:
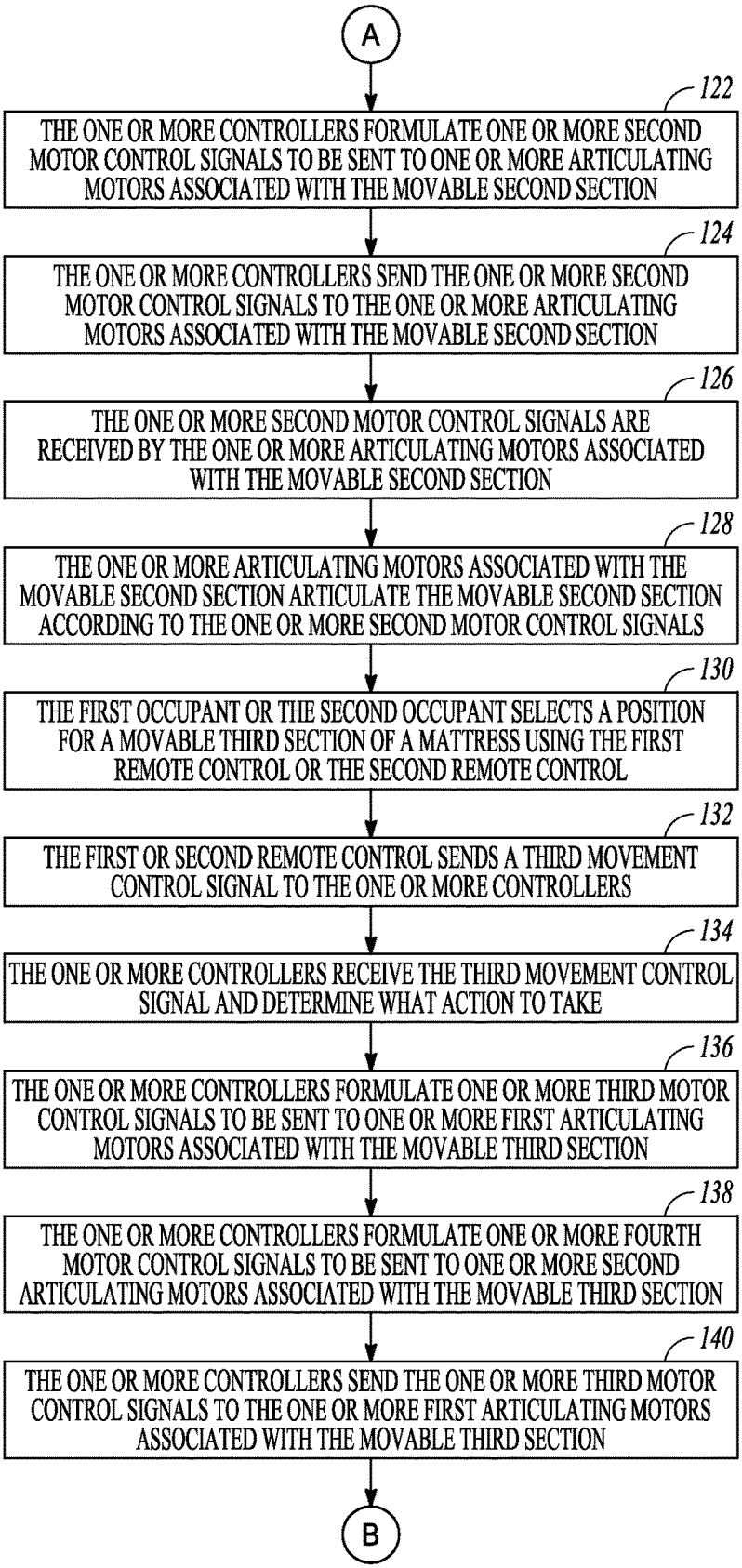
Figure 7C:
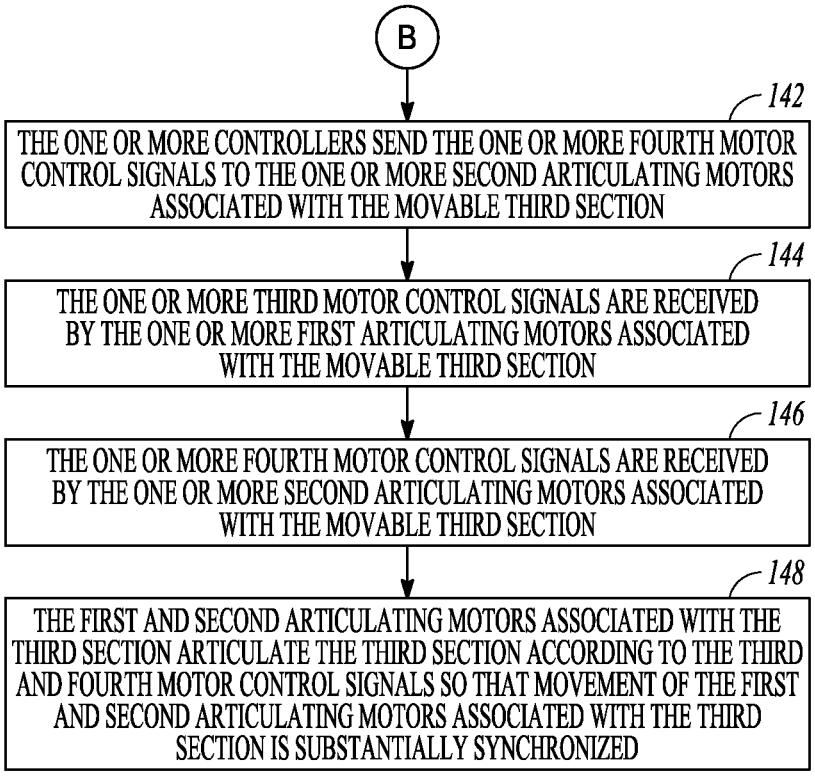

FIGS. 7A-7C show a flow diagram of an example method 100 of controlling articulation of the sleep system 10, 70, or 80. At 102, the first occupant 14 selects a particular position for a movable first section of the mattress 18, such as the first head section 24, using the first remote control 42. For example, the first occupant 14 can select a specific button or combination of buttons on the first remote control 42 that correspond to a "flat" position for the first head section 24 or a particular elevated position for the first head section 24, such as a snore reducing position, or a TV viewing or reading position.

At 104, the first remote control 42 can send a movement control signal to one or more controllers, such as the controller 60 (FIG. 4) or the two or more controllers 74 (FIG. 5) or controllers 84 (FIG. 6). The movement control signal can include a first address or other unique identifier that identifies that it is the first remote control 42 that is sending the movement control signal that is different from an address or unique identifier that is transmitted from other remote controls, such as the second remote control 44. The movement control signal can also include a second address or unique identifier that indicates which articulable section 24, 40 is to be moved according to the movement control signal, e.g., that indicates that the first head section 24 is to be moved according to the movement control signal. In an example, the movement control signal can include a header that includes a predetermined sequence of the first address (e.g., identifying the remote control 42, 44 sending the signal) and the second address (e.g., identifying the articulable section 24, 40 to be moved according to the instructions in the signal).

At 106, the one or more controllers 60, 74, 84 receive the movement control signal and determine what action to take. Determining what action to take can include the one or more controllers 60, 74, 84 determining which remote control 42, 44 sent the movement control signal, for example by analyzing the header and reading the address contained therein. A controller 60, 74, 84 the receives the movement control signal can then determine whether the movement control signal is intended for itself, or for another controller 60, 74, 84. In the case of a single controller 60, each movement control signal is intended for the controller 60 unless a remote control from another sleep system is being used. However, when more than one controller 74, 84 is included, as in FIGS. 5 and 6, then the movement control signal can be intended for both controllers 74, e.g., depending on whether a head section or leg section is to be articulated (as in the sleep system 70), or can be intended for only a particular controller 84 (e.g., where each remote control and each controller 84 are configured for only one sleep area, as in sleep system 80).

For example, in the sleep system 70 of FIG. 5, if the first controller 74A receives one or more first movement control signals with an address corresponding to the first remote control 42 that instructs to move the first head section 24, then the first controller 74A can determine that it should send one or more first motor control signals to the corresponding first head motor 52. But, if the first controller 74A receives a movement control signal with an address corresponding to the first remote control 42 that instructs to move the joined lower section 40, then the first controller 74A can determine that it should either ignore the movement control signal or pass the movement control signal to the second controller 74B, e.g., via the cable 79.

In another example, in the sleep system 80 of FIG. 6, if the first controller 84A receives a movement control signal with an address corresponding to the first remote control 42, then the first controller 84A can determine that it should send a motor control signal to one or more corresponding articulating motor 52, 56A, 56B. But, if the first controller 84A receives a movement control signal with an address corresponding to the second remote control 44, then the first controller 84A can choose to ignore the movement control signal or alternatively can pass the signal to the second controller 84B, e.g., via the cable 89.

At 108, the one or more controllers 60, 74, 84 can formulate a motor control signal to be sent to one or more of the articulating motors 52, 44, 56A, 56B. The motor control signal or signals for each articulating motor 52, 44, 56A, 56B can include what action the articulating motor 52, 44, 56A, 56B should take, such as what direction the articulating motor 52, 44, 56A, 56B should move, at what speed, and for how long. The motor control signal or signals can also include the timing and order of the actions that each articulating motor 52, 44, 56A, 56B is to take.

For example, if the controller 60 (or a first controller 74A or 84A in the case of two controllers) receives one or more first movement control signals from the first remote control 42 indicating that the first head section 24 should be articulated, then the controller 60, 74A, 84A can determine that one or more first motor control signals can be sent directly to the first head motor 52. In the case of systems with two or more controllers, if a second controller 74B, 84B receives the one or more first movement control signal from the first remote control 42 indicating that the first head section 24 should be articulated, then the second controller 74B, 84B can send a control signal to the first controller 74A, 84A via the cable 79, 89 that can trigger the first controller 74A, 84A to formulate one or more appropriate first motor control signals for the first head motor 52.

At 110, the controller 60, 74, 84 can send the one or more motor control signals to the appropriate articulating motor or motors 52, 44, 56A, 56B, such as via the cables 66, 76, 78, 86, or 88. In an example, the motor control signal can include an address or unique identifier corresponding to the articulating motor 52, 44, 56A, 56B to which the control signal is being directed. The address can be placed in a header of the control signal, similar to the address for the remote controls 42, 44 in the movement control signals described above.

In the case of one or more first movement control signals that are sent from the first controller 42 to articulate the first head section 24, the controller 60, 74A, or 84A can send the one or more first motor control signals to the first head motor 52 that will move the first head section 24 to be at the selected position indicated in the first movement control signal.

In an example, before sending a signal to the articulating motor 52, 44, 56A, 56B, the controller 60, 74, 84 can determine the current position of each articulable section 24, 30, 40. The controller 60, 74, 84 can store the current position of each articulable section 24, 30, 40 in a memory within the controller 60, 74, 84, or the controller 60, 74, 84 can determine the current position by requesting a position or orientation reading from a position sensor for each section 24, 30, 40. The controller 60, 74, 84 can compare the current position to the selected position to determine if a particular section 24, 30, 40 needs to be articulated and in what direction. For example, after accessing or determining the current position of the first head section 24 the controller 60, 74A, 84A can then determine what direction the first head section 24 is to be moved in order to facilitate the selected position. The controller 60, 74A, 84A can then send one or more first motor control signals to the first head motor 52 that corresponds to the direction in which the first head section 24 is to be articulated.

At 112, the motor control signal or signals can be received by one or more of the articulating motors 52, 44, 56A, 56B associated with the articulable section or sections 24, 30, 40 to be articulated. For example, the first head motor 52 can receive the one or more first motor control signals from the controller 60, 74A, 84A. At 114, the selected articulating motor or motors 52, 44, 56A, 56B can then articulate the corresponding articulable section or sections 24, 30, 40 according to the one or more motor control signals so that the selected articulable section or sections 24, 30, 40 can be moved into the desired position. For example, the first head motor 52 can articulate the first head section 24 to the selected position according to the one or more first motor control signals.

At 116, the second occupant 16 can select a position for a movable second section of the mattress 18, such as the second head section 30, using the second remote control 44. For example, the second occupant 16 can select a specific button or combination of buttons on the second remote control 44 that correspond to a "flat" position for the second head section 30 or a particular elevated position for the second head section 30, such as a snore reducing position, or a TV viewing or reading position.

At 118, the second remote control 44 can send the one or more second movement control signals to one or more controllers, such as the controller 60 (FIG. 4) or the two or more controllers 74 (FIG. 5) or controllers 84 (FIG. 6). The one or more second movement control signals can include a first address or other unique identifier that identifies that it is the second remote control 44 that is sending the movement control signal that is different from an address or unique identifier that is transmitted from other remote controls, such as the first remote control 42. The one or more second movement control signals can also include a second address or unique identifier that indicates which articulable section 30, 40 is to be moved according to the movement control signal, e.g., that indicates that the second head section 30 is to be moved according to the movement control signal.

At 120, the one or more controllers 60, 74A, 84B can receive the one or more second movement control signals and can determine what action to take, such as by determining that a motor control signal should be sent to the second head motor 54.

At 122, the one or more controllers 60, 74A, 84B can formulate one or more second motor control signals to be sent to the second head motor 54. The one or more second motor control signals can include what action the second head motor 54 should take, such as what direction the second head motor 54 should move, at what speed, and for how long. The one or more second motor control signals can also include the timing and order of the actions that the second head motor 54 is to take.

At 124, the controller 60, 74A, 84B can send the one or more second motor control signals to the second head motor 54, such as via a cable 66B, 76B, 88A. In an example, the motor control signal can include an address or unique identifier corresponding to the second head motor 54. The address can be placed in a header of the one or more second motor control signals, similar to the address for the remote controls 44 in the movement control signals described above. As noted above, the controller 60, 74A, 84B can determine the current position of the second head section 30 before sending the one or more second motor control signal.

At 126, the one or more second motor control signal or signals can be received by the second head motor 54. At 128, the second head motor 54B can then articulate the second head section 30 into the desired position according to the one or more second motor control signals.

At 130, either the first occupant 14 or the second occupant 16 can select a position for a movable third section of the mattress 18, such as the joined lower section 40, using the first remote control 42 or the second remote control 44, respectively. For example, the occupant 14, 16 can select a specific button or combination of buttons on his or her respective remote control 42, 44 that correspond to a "flat" position for the joined lower section 40 or a particular elevated position for the joined lower section 40.

At 132, the remote control 42, 44 can send one or more third movement control signals to one or more controllers 60, 74B, 84A/84B. At 134, the one or more controllers 60, 74B, 84A/84B can receive the one or more third movement control signals and determine what action or actions to take, such as by determining that a motor control signal should be sent to the leg motors 56A, 56B.

At 136, the one or more controllers 60, 74B, 84A/84B can formulate one or more third motor control signals to be sent to the first leg motor 56A. The one or more third motor control signals can include what action the first leg motor 56A should take, such as what direction the first leg motor 56A should move, at what speed, and for how long. The one or more third motor control signals can also include the timing and order of the actions that the first leg motor 56A is to take.

At 138, the one or more controllers 60, 74B, 84A/84B can formulate one or more fourth motor control signals to be sent to the second leg motor 56B. The one or more fourth motor control signals can include what action the second leg motor 56B should take, such as what direction the second leg motor 56B should move, at what speed, and for how long. The one or more fourth motor control signals can also include the timing and order of the actions that the second leg motor 56B is to take.

At 140, the controller 60, 74B, 84A/84B can send the one or more third motor control signals to the first leg motor 56A and can send the one or more fourth motor control signals to the second leg motor 56B. In an example, the one or more third motor control signals can include an address or unique identifier corresponding to the first leg motor 56A. At 142, the controller 60, 74B, 84A/84B can send the one or more fourth motor control signals to the second leg motor 56B. In an example, the one or more fourth motor control signals can include an address or unique identifier corresponding to the second leg motor 56B. As noted above, the controller 60, 74B, 84A/84B can determine the current position of the joined lower section 40 before sending the motor control signals.

At 144, the one or more third motor control signals can be received by the first leg motor 56A. At 146, the one or more fourth motor control signals can be received by the second leg motor 56B. At 148, the leg motors 56A, 56B can be articulated according to the one or more third motor control signals and the one or more fourth motor control signals in order to articulate the joined lower section 40 into the desired position. The one or more third motor control signals and the one or more fourth motor control signals are configured so that movement of the first leg motor 56A and the second leg motor 56B are substantially synchronized so that movement of the joined lower section 40 is substantially uniform across the width of the mattress 18.

Figure 8:
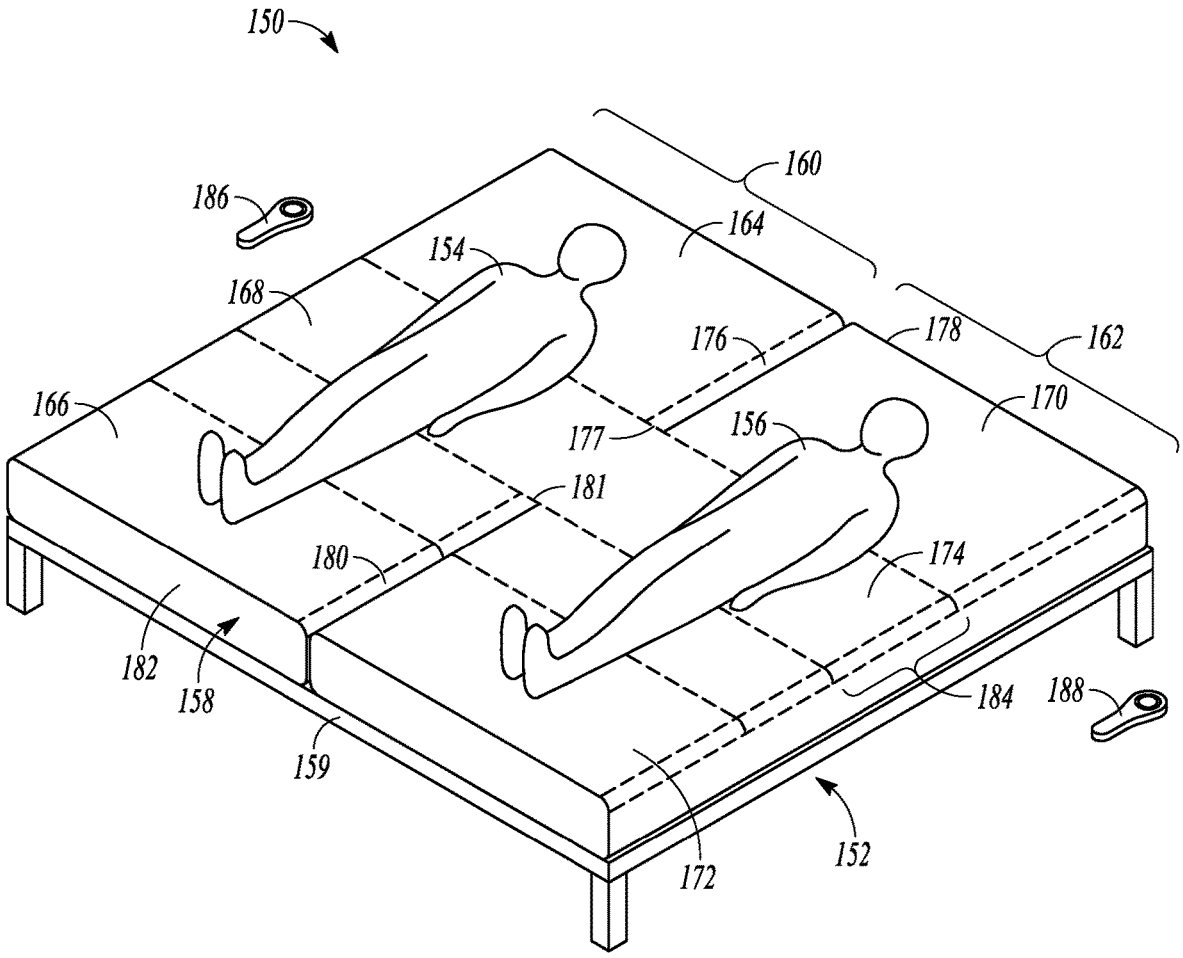
FIG. 8 is a perspective view of an example two-person sleep system including an adjustable bed having a split upper portion, a split lower portion, and a joined middle portion, shown with both sides of the bed being in a horizontal or flat position.
Figure 9:
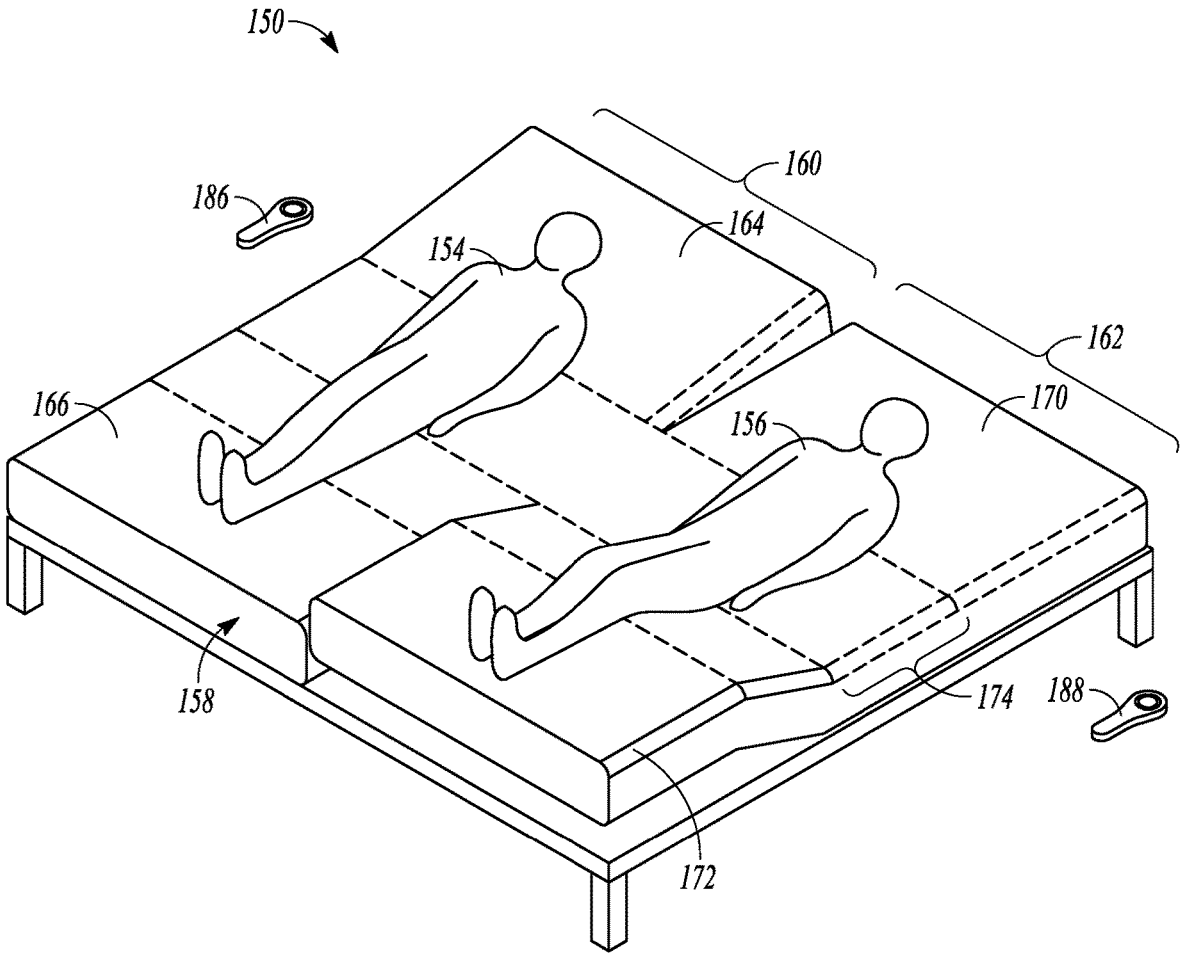
FIG. 9 is a perspective view of the example sleep system of FIG. 8 with a head portion and a leg portion of one of the sides of the bed being raised.
Figure 10:
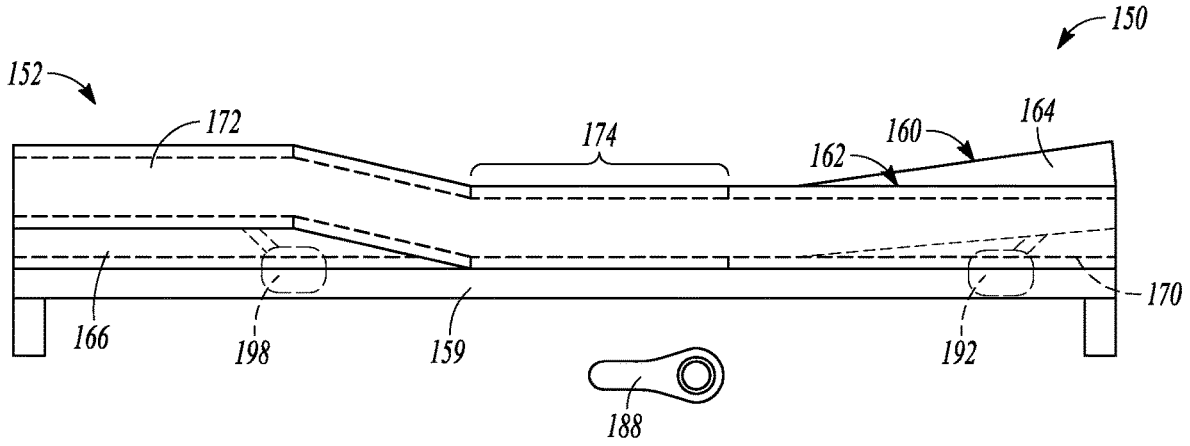
FIG. 10 is a side view of the example sleep system of FIGS. 8 and 9, shown with a head portion and a leg portion of one of the sides of the bed being raised.

FIGS. 8-10 show a second example of a sleep system 150. The sleep system 150 can include a bed 152 that is configured and intended to be used by two occupants, a first occupant 154 and a second occupant 156. The bed 152 can include a mattress 158 supported by a frame 159. The bed 152 can be conceptually divided into a first sleep area 160 for the first occupant 154 located on a first side of the bed 152 (e.g., the left side in FIGS. 8 and 9) and a second sleep area 162 for the second occupant 156 on a second side of the bed 152 (e.g., the right side in FIGS. 8 and 9). Thus, sleep system 150 in is similar to sleep system 10 shown in FIGS. 1-4.

Like with sleep system 10, at least a portion of each of the sleep areas 160, 162 can be movable or articulable between a plurality of positions to provide the occupants 154, 156 with the ability to select a preferred position for comfort of for a particular purpose. Each sleep area 160, 162 can include one or more articulable sections. In an example, the first sleep area 160 can include a section 164 that can be raised and lowered to adjust a position of the head or upper torso, or both, of the first occupant 154 (referred to herein as the first head section 164), a section 166 that can be raised and lowered to adjust a position of the legs or lower torso, or both, of the first occupant 154 (referred to herein as the first leg section 166), and a section 168 positioned longitudinally between the first head section 164 and the first leg section 166 (referred to herein as the first middle section 168). Similarly, the second sleep area 162 can include a section 170 that can be raised and lowered to adjust a position of the head or upper torso, or both, of the second occupant 156 (referred to herein as the second head section 170) that is adjacent to the first head section 164; a section 172 that can be raised and lowered to adjust a position of the legs or lower torso, or both, of the second occupant 156 (referred to herein as the second leg section 172) that is adjacent to the first leg section 166; and a section 174 positioned longitudinally between the second head section 170 and the second leg section 172 (referred to herein as the second middle section 174) that is adjacent to the first middle section 168. The middle sections 168, 164 can be configured to support the trunk area of the occupants 154, 156 (e.g., the middle torso around the waist and a portion of the upper legs), and can be configured to be movable (e.g., raised and lowered) or can be configured to be stationary and to remain in the same position and orientation throughout operation of the bed, depending on the desired operability of the bed 152.

As shown in FIGS. 8 and 9, the mattress 158 can be configured so that a first portion of the first sleep area 160 is independently articulable from a corresponding adjacent first portion of the second sleep area 162, and vice versa, so that the first portion of the second sleep area 162 is independently articulable from the corresponding first portion of the first sleep area 160. In the example shown in FIGS. 8 and 9, the first head section 164 and the second head section 170 are adjacent to one another and can be articulated upward or downward independent of one another. The independent articulation of the head sections 164, 170 can be provided for by a medial split 176 extending longitudinally from an upper end 178 of the mattress 158. As described in more detail below, each of the head sections 164, 170 can be articulated with one or more actuators, such as one or more articulable motors so that each head section 164, 170 is an independently movable section of the mattress 158.

As further shown in FIGS. 8 and 9, the mattress 158 can be configured so that a second portion of the first sleep area 160 is independently articulable from a corresponding adjacent second portion of the second sleep area 162, and vice versa, so that the second portion of the second sleep area 162 is independently articulable from the corresponding second portion of the first sleep area 160. In the example shown in FIGS. 8 and 9, the first leg section 166 and the second leg section 172 are adjacent to one another and can be articulated upward or downward independent of one another. The independent articulation of the leg sections 166, 172 can be provided for by a medial split 180 extending longitudinally from a lower end 182 of the mattress 158. As described in more detail below, each of the leg sections 166, 172 can be articulated with one or more actuators, such as one or more articulable motors so that each leg section 166, 172 is an independently movable section of the mattress 158.

The mattress 158 can also be configured so that a third portion of the first sleep area 160 and a corresponding third portion of the second sleep area 162 are coupled together and configured to either be stationary or to be moved together in a substantially synchronized manner. For example, as shown with the mattress 158 of FIGS. 8 and 9, the middle sections 168, 174 are joined together as a substantially unitary middle section so that the middle sections 168, 174 together resemble a single joined middle section 184 of the mattress 158. As described in more detail below, the sleep system 150 can be configured so that the middle sections 168, 174 can be stationary together, or can be configured so that the middle sections 168, 174 can be articulated together, e.g., by one or more articulation actuators, so that the middle sections 168, 174 can act together as a single stationary or movable joined middle section 184.

In this way, the sleep system 150 can include a mattress 158 comprising a first sleep area 160 for a first occupant 154, the first sleep area 160 comprising a first movable upper section, e.g., the first head section 164, and a first movable lower section, e.g., the first leg section 166. The mattress 158 can also include a second sleep area 162 for a second occupant 156, the second sleep area 162 comprising a second movable upper section adjacent to the first movable upper section, e.g., the second head section 170 adjacent to the first head section 164, and a second movable lower section adjacent to the first lower section, e.g., the second leg section 172 adjacent to the first leg section 166. The mattress 158 can further include a common middle section extending between the first sleep area and the second sleep area, e.g., the joined middle section 184, with the common middle section 184 being positioned between the movable upper section 164, 170 and the movable lower section 166, 172 of each of the first sleep area 160 and the second sleep area 162. The mattress 158 can be an air bed comprising separate sets of air bladders or air chambers (described in more detail below). Thus, the mattress 158 can include a set of one or more first air chambers being carried by the first movable upper section 164, the first movable lower section 166, and a first portion of the common middle section 184, e.g., the first middle section 168 that makes up the portion of the joined middle section 184 in the first sleep area 160. Similarly, the mattress 158 can also include a set of one or more second air chambers carried by the second movable upper section 170, the second movable lower section 172, and a second portion of the common middle section 184, e.g., the second middle section 174 that makes up the portion of the joined middle section 184 in the second sleep area 162.

Figure 11:
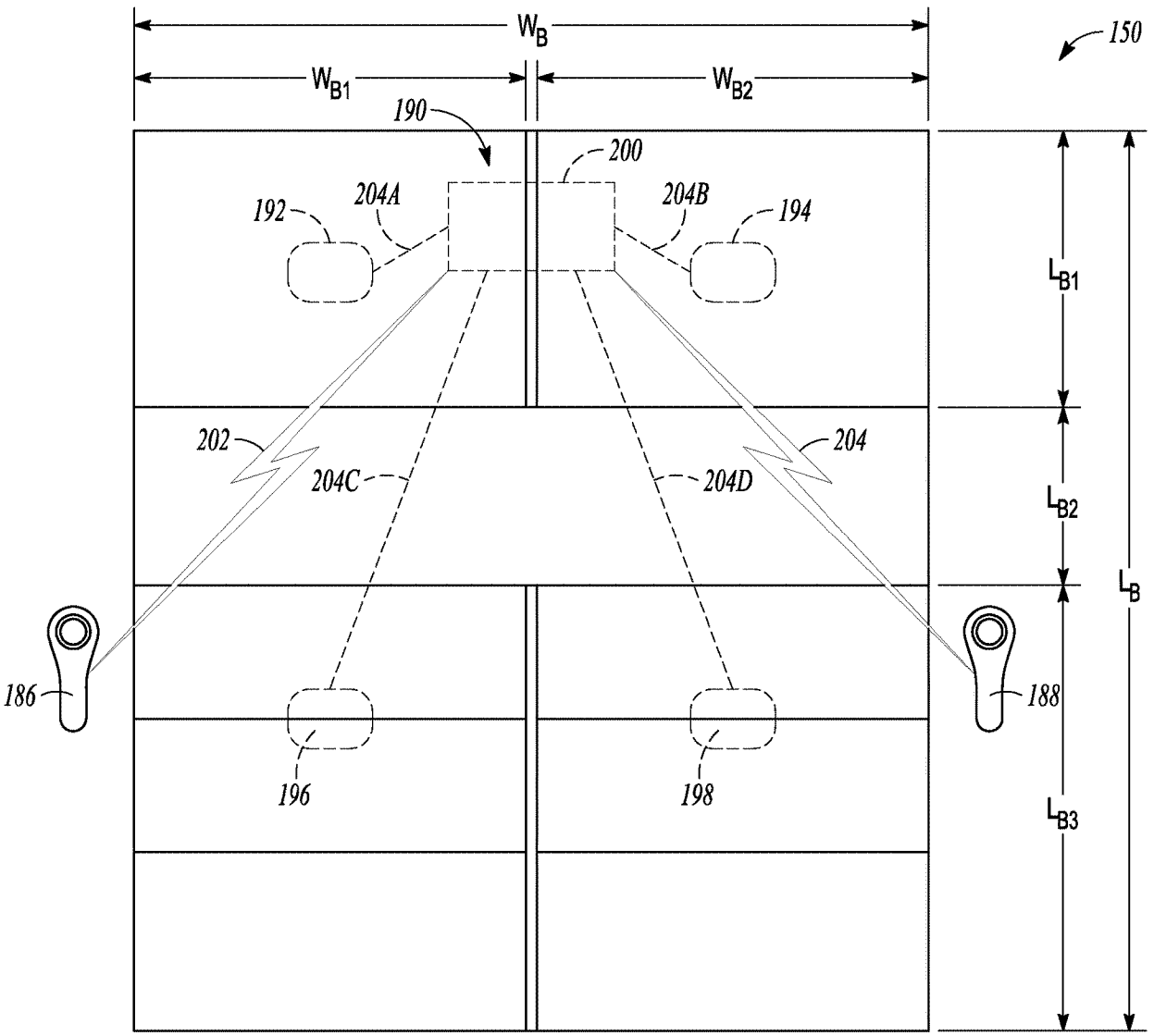
FIG. 11 is a top view of the example sleep system of FIGS. 8-10.

As best shown in FIG. 11, the mattress 158 can comprise the movable first section (e.g., the first head section 164) extending laterally along a first portion $W_{B1}$ of the total width $W_B$ of the mattress 158 and extending longitudinally along a first portion $L_{B1}$ of the total length $L_B$ of the mattress 158. Similarly, the mattress 158 can comprise a movable second section (e.g., the second head section 170) extending laterally along a second portion $W_{B2}$ of the width $W_B$ of the mattress 158 and extending longitudinally along the same first portion $L_{B1}$ of the length $L_B$ of the mattress 158 as the first movable section (e.g., the first head section 164). The mattress 158 can also comprise a movable third section (e.g., the first leg section 166) extending laterally along the same first portion $W_{B1}$ of the total width $W_B$ as the movable first section (e.g., the first head section 164) and extending longitudinally along a second portion $L_{B2}$ of the length $L_B$ of the mattress 158. The mattress 158 can also comprise a movable fourth section (e.g., the second leg section 172) extending laterally along the same second portion $W_{B2}$ of the width $W_B$ of the mattress 158 as the movable second section (e.g., the second head section 170) and extending longitudinally along the same second portion $L_{B2}$ of the length $L_B$ as the movable third section (e.g., the first leg section 166B) of the mattress 158. The mattress 158 can also comprise a fifth section (e.g., the joined middle section 184), which may or may not be movable or articulable, extending laterally along substantially the entire width $W_B$ of the mattress 158 and extending longitudinally along a third portion $L_{B3}$ of the length $L_B$ of the mattress 158, where the third portion $L_{B3}$ of the length $L_B$ can extend medially between the first portion $L_{B1}$ of the length $L_B$ and the second portion $L_{B2}$ of the length $L_B$.

The mattress 158 can include one or more supporting structures for supporting the occupants 154, 156 within the movable first section (e.g., the first head section 164), the movable second section (e.g., the second head section 170), the movable third section (e.g., the first leg section 166), the movable fourth section (e.g., the second leg section 172), and the fifth section (e.g., the joined middle section 184). In an example, the mattress 158 can include a set of one or more supporting structures, such as one or more first air chambers, for the first sleep area 160, for example, carried in a case the forms the first movable section (e.g., the first head section 164), the third movable section (e.g., the second leg section 172), and the fifth section (e.g., the joined middle section 184). The mattress 158 can also comprise one or more second supporting structures, such as one or more second air chambers, for the second sleep area 162, for example, carried in the second movable section (e.g., the second head section 170), the fourth movable section (e.g., the second leg section 172), and the fifth section (e.g., the joined middle section 184).

The sleep system 150 can also include a pair of user controlling devices 186, 188 to allow each occupant 154, 156 to control the articulation of his or her respective sleep area 160, 162. As shown in FIGS. 8-11, the sleep system 150 can include a first user controlling device 186, e.g., a first handheld remote control 186, that has been programmed to control operation of the first sleep area 160, and a second user control device 188, e.g., a second handheld remote control 188, that has been programmed to control operation of the second sleep area 162. The first occupant 154 can use the first remote control 186 to control operation of the first sleep area 160, upon which the first occupant 154 is lying, and the second occupant 156 can use the second remote control 188 to control operation of the second sleep area 162 upon which the second occupant 156 is lying. In order to ensure proper linking between each remote control 186, 188 and the corresponding sleep area 160, 162, each remote control 186, 188 can include an address or other unique identifier, for example to distinguish the first remote control 186 from the second remote control 188.

In an example, the first occupant 154 can select, via the first remote control 186, to control articulation of the first head section 164 upward or downward by a certain amount and/or to control articulation of the first leg section 166 upward or downward by a certain amount. The first remote control 186 can also be configured to control articulation of the joined middle section 184 (e.g., to control articulation of the joined middle sections 168, 174) if the sleep system 150 is configured so that the joined middle section 184 can be articulated. The second occupant 156 can select, via the second remote control 188, to control articulation of the second head section 170 upward or downward by a certain amount and/or to control articulation of the second leg section 172 upward or downward by a certain amount. The first remote control 186 can also be configured to control articulation of the joined middle section 184 if the sleep system 150 is configured so that the joined middle section 184 can be articulated. In an example, articulation of the joined middle section 184 can be controlled by only the first remote control 186, by only the second remote control 188, or by both the first remote control 186 and the second remote control 188.

In an example, articulation of any one of sections 164, 166, 170, 127 and (if it is articulable) 184 can be controlled to occur continuously or along a discrete set of positions between a minimum height or orientation and a maximum height or orientation. For example, the head sections 164, 170 and the leg sections 166, 172 can be articulable from a minimum height position (e.g., flat) to a maximum height position (e.g., with the head section 164, 170 at a maximum programmed angle with respect horizontal, such as about 60°, or with the leg section 166, 172 forming a maximum programmed angle with respect to horizontal, such as about 45°).

Like the sleep system 10 described above, the sleep system 150 can also be configured so that each sleep area 160, 162 can be positioned into one or more predetermined or preset positions. For each preset position, the head section 164, 170, the leg section 166, 172, and in some cases, the joined middle section 184, can be moved to predetermined positions or orientations. Examples of preset positions that can each be programmed into the sleep system 10 include, but are not limited to: a flat preset (described above), a "reading" preset (described above), a "television" preset (described above), and a "snore" present.

In examples where the supporting structures of the mattress 158 comprise air chambers, the sleep system 150 can also comprise an inflation system configured to control the pressure within the air chambers. The inflation system can comprise one or more pumps configured to inflate or deflate the air chambers, and one or more controllers configured to control the one or more pumps. In an example, the one or more controllers that control articulation of the mattress 158 (e.g., the controller 200 or the controllers 214A, 214B) can also be configured to control operation of the one or more pumps. In another example, one or more separate controllers for controlling operation of the one or more inflation pumps can be provided that are separate from the one or more controllers for controlling articulation of the mattress 158.

In an example, the inflation system can provide for individual control of the air pressure within each air chamber or within one or more sets of air chambers. For example, if a first set of one or more air chambers is located in the first sleep area 160 and a second set of one or more air chambers is located in the second sleep area 162, then the inflation system can be configured to individually control the pressure in the first set of air chambers in order to control the firmness of one or more portions or the entirety of the first sleep area 160 and the inflation system can be configured to individually control the pressure in the second set of air chambers in order to control the firmness of one or more portions or the entirety of the second sleep area 162. In an example, the user controlling devices 186, 188 can also be configured to control the inflation system, such as by communicating with the controllers of the inflation system to control the pump. Each user controlling device 186, 188 can be configured to control inflation of the air chambers associated with a corresponding one of the sleep areas 160, 162, e.g., so that the first occupant 154 can control the firmness of the first sleep area 160 and the second occupant 156 can control the firmness of the second sleep area 162.

FIG. 11 shows a top view of the sleep system 150. As shown in FIG. 11, the sleep system 150 can include an articulation system 190 for controlling articulation of the articulable sections 164, 166, 170, 172, and (if articulable) 184. The articulation system 190 can include a set of articulating actuators, with each articulable section being articulated by one or more of the actuators. An example of an actuator that can be used for articulating the articulable sections 164, 166, 170, 172 can include one or more motors. For example, the articulation system 190 can include one or more head motors configured to move the head sections 164, 170. For example, a first head motor 192 can be configured to articulate the first head section 164 of the first sleep area 160 and a second head motor 194 can be configured to articulate the second head section 170 of the second sleep area 162. The articulation system 190 can also include one or more leg motors configured to articulate the leg section 166, 172. For example, as shown in FIG. 11, a first leg motor 196 can be configured to articulate the first leg section 166 of the first sleep area 160 and a second leg motor 198 can be configured to articulate the second leg section 172 of the second sleep area 162. One or more middle motors (not shown) can also be included and can be configured to articulate the joined middle section 184.

The articulation system 190 can also include one or more controllers, such as a control box that includes the electronics and hardware for providing instructions to the articulating motors 192, 194, 196, 198. FIG. 11 is a top view of the example sleep system 150, showing the articulation system 190 including a single, common controller 200 that is configured to control each of the sleep areas 160, 162, e.g., each of the articulating motors 192, 194, 196, 198. Each remote control 186, 188 can be in communication with the controller 200, such as via a wireless communication link 202, 204. The remote controls 186, 188 can send movement control signals to the controller 200 via the wireless communication link 202, 204. A "movement control signal," as used herein, can refer to a signal or plurality of signals sent from a remote controls 186, 188 to the controller 200 corresponding to a particular movement or position of one or more of the articulable sections 164, 166, 168, 170. A movement control signal can include one or more instructions for the direction of movement of a particular articulable section 164, 166, 168, 170, e.g., the direction of movement of a corresponding articulating motor 192, 194, 196, 198, a speed for the movement of a particular articulable section 164, 166, 168, 170 or of a particular articulating motors 192, 194, 196, 198, or an overall position of the corresponding sleep area 160, 162 being controlled by the remote control 186, 188, such as a preset position.

The controller 200 can send one or more motor control signals to one or more of the articulating motors 192, 194, 196, 198 corresponding to a desired motion of each articulating motors 192, 194, 196, 198. A "motor control signal," as used herein, can refer to a signal or plurality of signals sent from a controller, such as the controller 200, to one or more articulating motors 192, 194, 196, 198 corresponding to a particular movement or position of one or more articulable sections 164, 166, 168, 170. A motor control signal or signals can comprise an instruction for one or both of the direction that each articulating motor 192, 194, 196, 198 should articulate and the speed at which the articulating motor 192, 194, 196, 198 should travel. In an example, a plurality of communication cables 204A, 204B, 204C, and 204D (collectively referred to herein as "cable 204" or "cables 204") can carry the motor control signals from the controller 200 to the articulating motors 192, 194, 196, 198, with each cable 204 corresponding to a particular motor (such as a first cable 204A for the first head motor 192, a second cable 204B for the second head motor 194, a third cable 204C for the first leg motor 196, and a fourth cable 204D for the second leg motor 198).

In another example, a sleep system 210 can include an articulating system 212 having more than a single common controller. In the example shown in FIG. 12, each sleep area 160, 162 can have its own controller, such as a first controller 214A corresponding to the first sleep area 160, e.g., by being configured to control the first head motor 192 and the first leg motor 196, and a second controller 214B corresponding to the second sleep area 162, e.g., by being configured to control the second head motor 194 and the second leg motor 198. In such an example, the first remote control 186 can be linked to the first controller 214A via a first wireless communication link 216A and the first controller 214A can be configured to respond to commands sent from the first remote control 186 and not from the second remote control 188. The second remote control 188 can be linked to the second controller 214B via a second wireless communication link 216B and the second controller 214B can be configured to respond to commands sent from the second remote control 188 and not from the first remote control 186.

If, for example, the first occupant 154 wishes to articulate his or her head and upper torso upward or downward, he or she can make a selection on the first remote control 186 that can instigate the transmission of a movement control signal from the first remote control 186 via the first wireless communication link 216A to the first controller 214A, which in turn can send a motor control signal to the first head motor 192. Similarly, if the first occupant 154 wishes to articulate his or her feet, he or she can make a selection on the first remote control 186 that can instigate the transmission of a movement control signal via the first wireless communication link 216A to the first controller 214A, which in turn can send a motor control signal to the first leg motor 196. If, for example, the second occupant 156 wishes to articulate his or her head and upper torso upward or downward, he or she can make a selection on the second remote control 188 that can instigate the transmission of a movement control signal from the second remote control 188 via the second wireless communication link 216B to the second controller 214B, which in turn can send a motor control signal to the second head motor 194. Similarly, if the second occupant 156 wishes to articulate his or her feet, he or she can make a selection on the second remote control 188 that can instigate the transmission of a movement control signal via the second wireless communication link 216B to the second controller 214B, which in turn can send a motor control signal to the second leg motor 198.

Each separate controller 214A, 214B (collectively referred to herein as "controller 214" or "controllers 214") can include communication links, such as cables, to the articulating motors 192, 194, 196, 198 that are controlled by that particular controller 214. For example, the first controller 214A can be linked to the first head motor 192 via a first cable 218A and to the first leg motor 196 via a second cable 218B. Similarly, the second controller 214B can be linked to the second head motor 194 via a first cable 220A and to the second leg motor 198 via a second cable 220B. The controllers 214A and 214B can be in communication with each other via a communication link, such as a cable 222 running between the controllers 214A, 214B to pass control signals between the controllers 214A, 214B.

Each set of one or more supporting structures can include any type of supporting structure that can be used for supporting an occupant 14, 16, 154, 156 that is using a sleep system 10, 70, 80, 150, 210 in accordance with the present description. Examples of supporting structures that can be used within a mattress 18, 158 can include innerspring supporting structures, foam (e.g., "memory" foam) supporting structures, and fluid-based supporting structures, such as air chambers or air bladders. Examples of air bladder or air chamber systems are described in U.S. Provisional Patent Application Ser. No. 61/728,094, entitled "Multi-Zone Air Chamber and Mattress System," filed on Nov. 19, 2012, and U.S. patent application Ser. No. 13/828,985, entitled "Multi-Zone Fluid Chamber and Mattress System," filed on Mar. 14, 2013, the disclosures of which are incorporated herein FIG. 13 shows a schematic diagram of a controller 250, which can represent, for example, the single controller 60 of the example sleep system 10 shown in FIG. 4, one of the plurality of controllers 74A and 74B of the example sleep system 70 shown in FIG. 5, one of the plurality of controllers 84A and 84B of the example sleep system 80 shown in FIG. 6, the single controller 200 of the example sleep system 150 shown in FIG. 11, or one of the plurality of controllers 214A, 214B of the example sleep system 210 shown in FIG. 12.

The controller 250 can include one or more communication modules to allow the controller 250 to communicate with the remote controls 42, 44, 186, or 188, the articulating motors 52, 54, 56A, 56B, 192, 194, 196, 198, and another controller (if the controller 250 is part of a multi-controller sleep system). The communication modules can include a telemetry module 252 and a communication bus 254. The telemetry module 252 can allow for the wireless transfer of data, such as control signals, to and from one or both of the remote controls 42, 44, 186, 188 by establishing the wireless communication link 62, 64, 202, 204 between the telemetry module 252 and a similar corresponding telemetry module within each remote control 42, 44, 186, 188. The telemetry module 252 can include a radio frequency (RF) transceiver to permit bi-directional communication between the controller 250 and the remote controls 42, 44, 186, 188. To support wireless communication, such as RF communication, the telemetry module 252 can include appropriate electrical components, such as one or more of amplifiers, filters, mixers, encoders, decoders, and the like.

Figure 12:
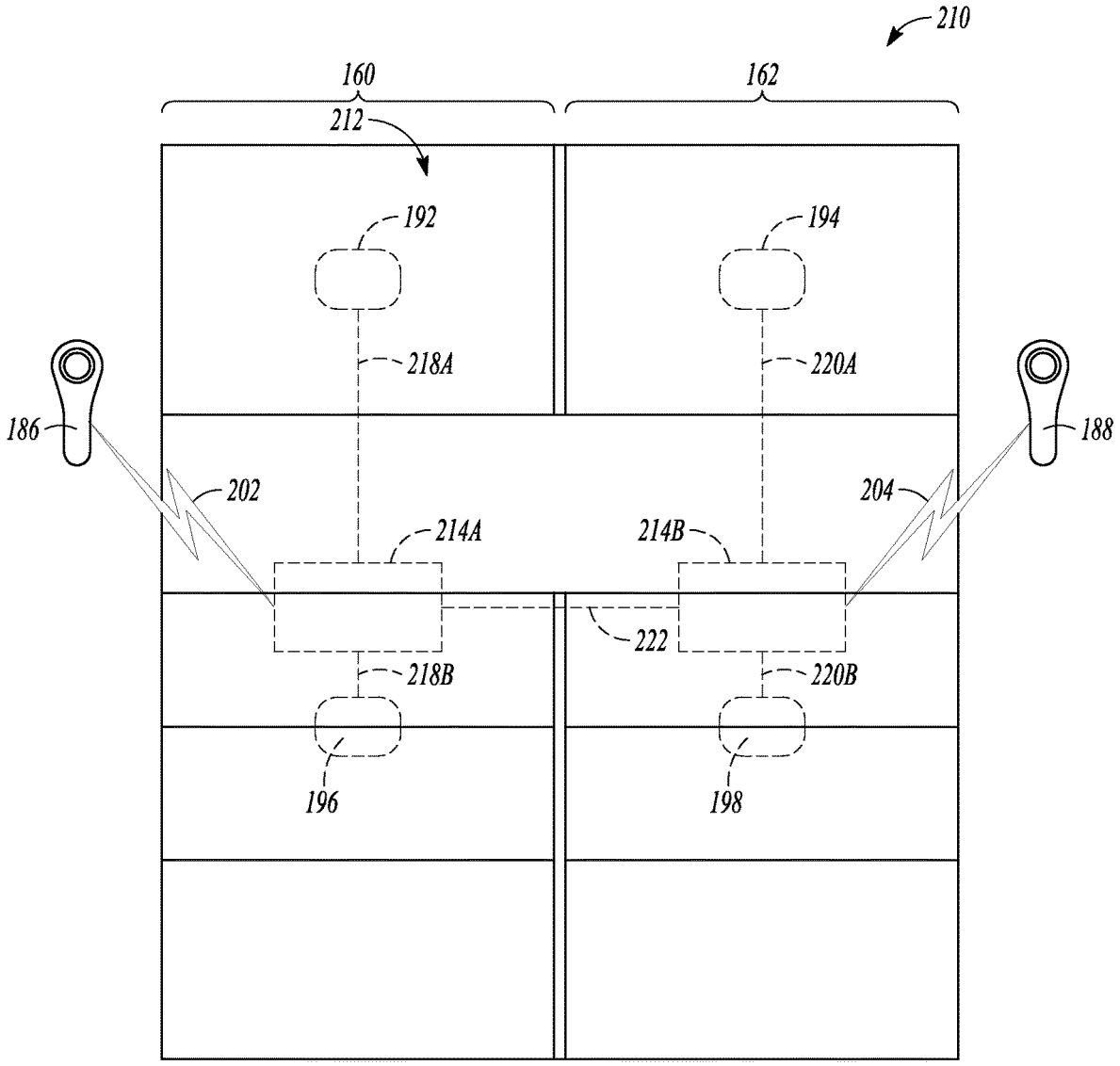
FIG. 12 is a top view of another example two-person sleep system including an adjustable bed having a split upper portion, a split lower portion, and a joined middle portion.
Figure 13:
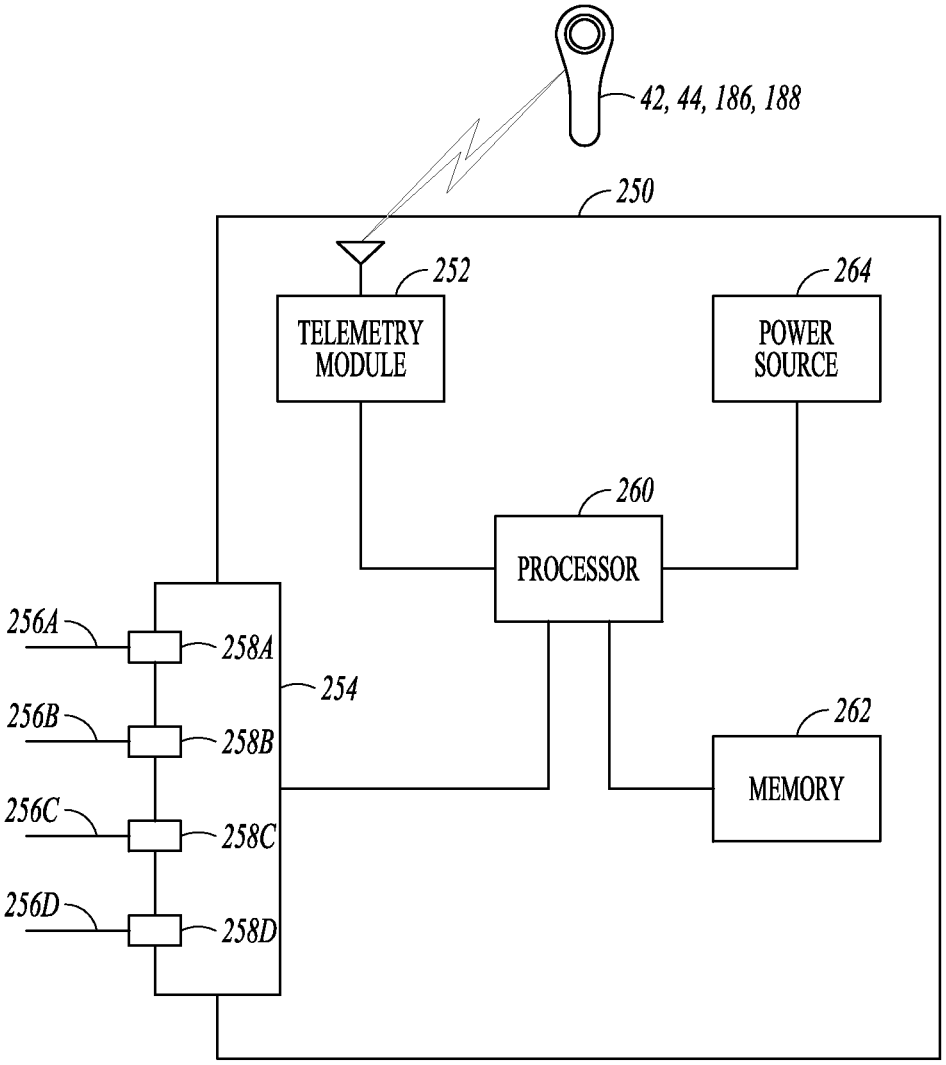
FIG. 13 is a schematic diagram of an example controller for controlling actuators of an adjustable sleep system.

The communication bus 254 can provide for a physical communication link to the controller 250, such as via the one or more cables 256A, 256B, 256C, 256D (collectively "cable 256" or "cables 256"), which can correspond to the cables 66 from the controller 60 in FIG. 4, the cables 76A, 76B, 78A, 78B, and 79 from the controllers 74A, 74B in FIG. 5, the cables 86A, 86B, 88A, 88B, and 89 from the controllers 84A, 84B in FIG. 6, or the cables 218A, 218B, 220A, 220B from the controllers 214A, 214B in FIG. 12. The communication bus 254 can include one or more physical ports 258A, 258B, 258C, 258D (collectively "port 258" or "ports 258"), each configured to provide for connection to a corresponding cable 256.

Each port 98 can be addressed to correspond to a particular communication link that is to be established. For example, in the case of the single controller 60 of FIG. 4, a first port 258A can be addressed to correspond to a link to the first head motor 52, a second port 258B can be addressed to correspond to a link to the second head motor 54, a third port 258C can be addressed to correspond to a link to the first leg motor 56A, and a fourth port 258D can be addressed to correspond to a link to the second leg motor 56B. In the example of separate controllers, such as the controllers 74A, 74B configured for separate control of the upper portion and the lower portion of the mattress 18, respectively, a first port 258A of a first one of the controllers, such as the first controller 74A, can be addressed to correspond to a link to the other controller 74B, a second port 258B can be addressed to correspond to a link to the first head motor 52, and a third port 258C can be addressed to correspond to the second head motor 54. For the second controller, such as the second controller 74B, the first port 258A can be addressed to correspond to the link to the other controller 74A, the second port 258B can be addressed to correspond to a link to the first leg motor 56A, and the third port 258C can be addressed to correspond to a link to the second leg motor 56B.

In the example of the separate controllers 84A, 84B for each of the sleep areas 20, 22, the first port 258A of each controller can be addressed to correspond to a link to the other controller, the second port 258B can be addressed to correspond to a link to a corresponding head motor (such as the first head motor 52 or the second head motor 54), and the third port 258C can be addressed to correspond to a link to a corresponding leg motor (such as the first leg motor 56A or the second leg motor 56B).

The controller 250 can also include a processor 260, a memory 262, and a power source 264. The processor 260 can control the overall operation of the controller 250, such as by storing and retrieving information from the memory 262, by controlling transmission of signals to and from the remote controls 42, 44, 186, 188 via the telemetry module 252, and controlling transmission of signals to and from the articulating motors 52, 54, 56A, 56B, 192, 194, 196, 198, or another controller via the communication bus 254. The processor 260 can take the form of one or more microprocessors, one or more controllers, one or more digital signal processor (DSP), one or more application-specific integrated circuit (ASIC), one or more field-programmable gate array (FPGA), or other digital logic circuitry.

The memory 262 can store instructions for execution by the processor 260, such as predetermined control instructions for the articulating motors 52, 54, 56A, 56B, 192, 194, 196, 198. The memory 262 can also store information corresponding to the operation of the sleep system 10, 70, 80, 150, 210 such as storing addresses identifying each remote control 42, 44, 186, 188 or each articulating motor 52, 54, 56A, 56B, 192, 194, 196, 198. The memory 262 can also store other information regarding the components of the sleep system 10, 70, 80, 150, 210 such as the present configuration of each articulable section 24, 30, 40, 164, 166, 170, 172, 184 or the present position of each articulating motor 52, 54, 56A, 56B, 192, 194, 196, 198, or both. The memory 262 can also store preset positions of each articulable section 24, 30, 40, 164, 166, 170, 172, 184 or each articulating motor 52, 54, 56A, 56B, 192, 194, 196, 198, or both, with each preset position corresponding to a particular preset position of the sleep areas 20, 22, 160, 162 (as described in more detail above). The memory 262 can include any electronic data storage media, such as any one or more of random access memory (RAM), read-only memory (ROM), electronically-erasable programmable ROM (EEPROM), flash memory, and the like.

Alternatively, or in conjunction with memory 262, the sleep system 10, 70, 80, 150, 210 can include one or more positional sensors configured to determine a position or orientation of each of the articulable sections 24, 30, 40, 164, 166, 170, 172, 184 or each of the articulating motors 52, 54, 56A, 56B, 192, 194, 196, 198, or both. The one or more positional sensors can transmit the position or orientation of each articulable section 24, 30, 40, 164, 166, 170, 172, 184 or each articulating motor 52, 54, 56A, 56B, 192, 194, 196, 198, or both, to the controller 250. Examples of positional sensors that can be used with the sleep systems of the present disclosure include, but are not limited to, accelerometers and gyroscope positional or orientation sensors. Alternatively, a sensor can be included on the motors 52, 54, 56A, 56B, 192, 194, 196, 198, such as a motor encoder, to determine a position of the motor or an actuator moved by the motor. Other types of positional or orientation sensors can be used.

The power source 264 can comprise power circuitry that is connectable to an external power supply, such as a standard alternating current (AC) power supply. The power source 264 can also include a battery, such as a non-rechargeable primary cell battery or a rechargeable battery, which can be coupled to the power circuitry.

As described above, each sleep area 20, 22, 160, 162 can be controlled by a corresponding remote control 42, 44, 186, 188, such as the first remote control 42, 186 controlling the first sleep area 20, 160 and the second remote control 44, 188 controlling the second sleep area 22, 162. As further described above, the sleep system 10, 70, 80, 150, 210 can be configured so that the first remote control 42, 186 is linked to the first sleep area 20, 160, e.g., so that when the first occupant 14, 154 selects a movement command on the first remote control 42,186, the articulation system 50, 72, 190 correctly articulates the first sleep area 20, 160 occupied by the first occupant 14, 154 rather than the second sleep area 22, 162 occupied by the second occupant 16, 156. Similarly, the sleep system 10, 70, 80, 150, 210 can be configured so that the second remote control 44,188 is linked to the second sleep area 22, 162.

In order to ensure proper linking between each remote control 42, 44, 186, 188 and the corresponding sleep area 20, 22, 160, 162, each remote control 42, 44, 186, 188 can have an address or other unique identifier. The address can allow the controller 250 (e.g., the controller 60, the controllers 74A, 74B, the controllers 84A, 84B, the controller 200, or the controllers 214A, 214B) to identify which remote control 42, 44, 186, 188 is sending a movement control signal. For example, when the first remote control 42, 186 sends a movement control signal to the controller 250, the movement control signal can include a header that includes the address for the first remote control 42,186. Upon receiving the movement control signal, the controller 250 can read the header including the address and determine that the movement control signal came from the first remote controller 42, 186. The controller 250 can then determine that the movement control signal should correspond to the first sleep area 20, 160, and the controller 250 can relay a corresponding motor control signal or signals to the appropriate motors 52, 56A, 56B, 192, 196 to articulate the first sleep area 20, 160. Similarly, when the second remote control 44, 188 sends a movement control signal to the controller 250, the movement control signal can include a header with the address for the second remote control 44, 188. The controller 250 can then send a corresponding control signal to the appropriate motors 54, 56A, 56B, 194, 198 to articulate the second sleep area 22, 162.

Each remote control 42, 44, 186, 188 can be configured to allow an occupant 14, 16, 154, 156 operating remote control 42, 44, 186, 188 to select a specific, desired movement of the sleep system 10, 70, 80, 150, 210. Selection of the desired movement by the occupant 14, 16, 154, 156 can, in turn, trigger a corresponding movement control signal to be sent from the remote control 42, 44, 186, 188 to the controller 250. Examples of movements that can be selected by an occupant 14, 16, 154, 156 on each remote control 42, 44, 186, 188 can include, but are not limited to, at least one of the following commands: raise a first section,e.g., a command to raise a head section 24, 30; lower a first section, e.g., a command to lower a head section 24, 30, 164, 170; raise a second section, e.g., a command to raise the joined lower section 40 or to raise a leg section 166, 172; lower a second section, e.g., a command to lower the joined lower section 40 or to lower a leg section 166, 172; or move one or both of the first section and the second section into a preset position, such as a flat position, a reading position, a "watch TV" position, and so forth.

Each command can be activated by activating a particular button, series of buttons, or series of menu selections, on the remote control 42, 44, 186, 188. Each button or menu selection can be a physical button or can be a virtual button, such as a button on a touch screen, or a series of button presses or menu prompts that are entered through physical or virtual buttons.

As noted above, each remote control 42, 44, 186, 188 can be configured to control the articulation of the articulable sections 24, 30, 40, 164, 166, 170, 172, 184 of a corresponding sleep area 20, 22, 160, 162. In other words, each occupant 14, 16, 154, 156 can control the articulation of his or her own sleep area 20, 22, 160, 162. In the case of the example sleep systems 10, 70, and 80 of FIGS. 1-6 (e.g., with a joined section spanning both sleep areas 20, 22, such as the joined lower section 40), each occupant 14, 16, 154, 156 can also control the joined section that spans both sleep area 20, 22, e.g., controlling the joined lower section 40. Alternatively, only one of the remote controls 42, 44 could be configured to control the joined section, e.g., the joined lower section 40, while the other remote control 42, 44 can be configured to only control a corresponding head section 24, 30.

The split-section sleep systems 10, 70, 80, 150, 210 described above can result in additional challenges for providing an optimized sleep environment for the occupants 14, 16, 154, 156. For example, adjacent movable sections of the sleep system 10, 70, 80, 150, 210, such as the adjacent articulable head sections 24, 30, 164, 170, as in sleep systems 10, 70, 80, 150, 210, or the adjacent articulable leg sections 168, 172, as in sleep systems 150, 210, can result in difficulties for a bed sheet that is configured to fit over the mattress 18, 158 of the sleep system 10, 70, 80, 150, 210. For example, if the adjacent sections are in close proximity to one another, adjacent portions of the sheet can be in contact, which can result in premature wear of the contacted portions. The friction of the adjacent portions of the sheet can also cause the sheet to move relative to the mattress 18, 158 and become bunched or even partially separated from the mattress 18, 158.

The sheet also can be subjected to additional stress at a joint where two adjacent articulable sections join together, such as at the joint 37 at the end of the medial split 36 between the first head section 24 and the second head section 30 (FIG. 1), the joint 177 at the end of the medial split 176 between the first head section 164 and the second head section 170 (FIG. 8), or the joint 181 at the end of the medial split 180 between the first leg section 166 and the second leg section 172 (FIG. 8). The movement of the adjacent articulable section 24 and 30, 164 and 170, and 166 and 172 can cause pulling on the material of the sheet which can be further exacerbated by the occupants 14, 16, 154, 156 sitting or lying on the bed.

Figure 14:
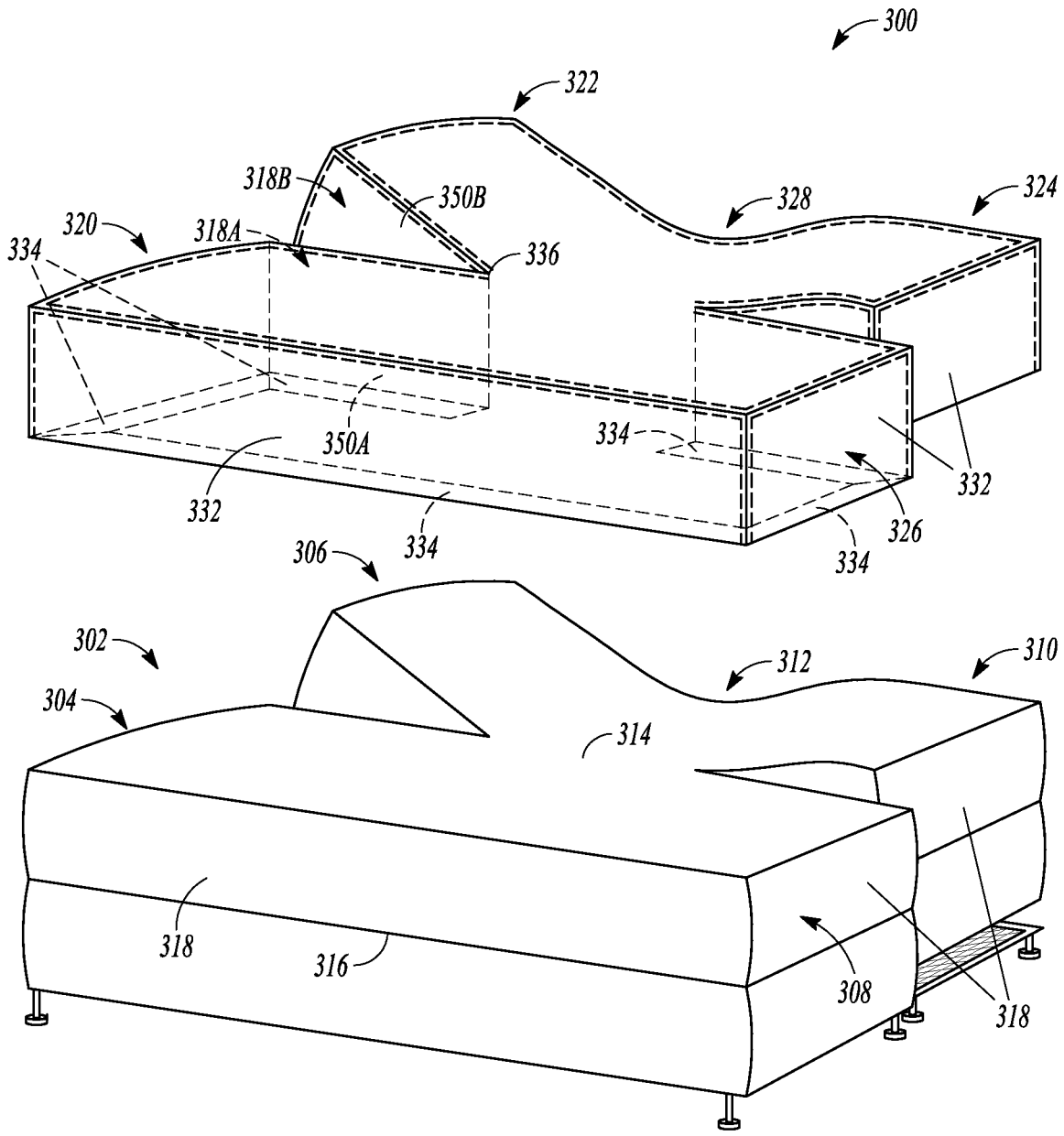
FIG. 14 is a perspective view of an example sheet configured to cover an example mattress having a split upper portion, a split lower portion, and a joined middle portion.
Figure 15:
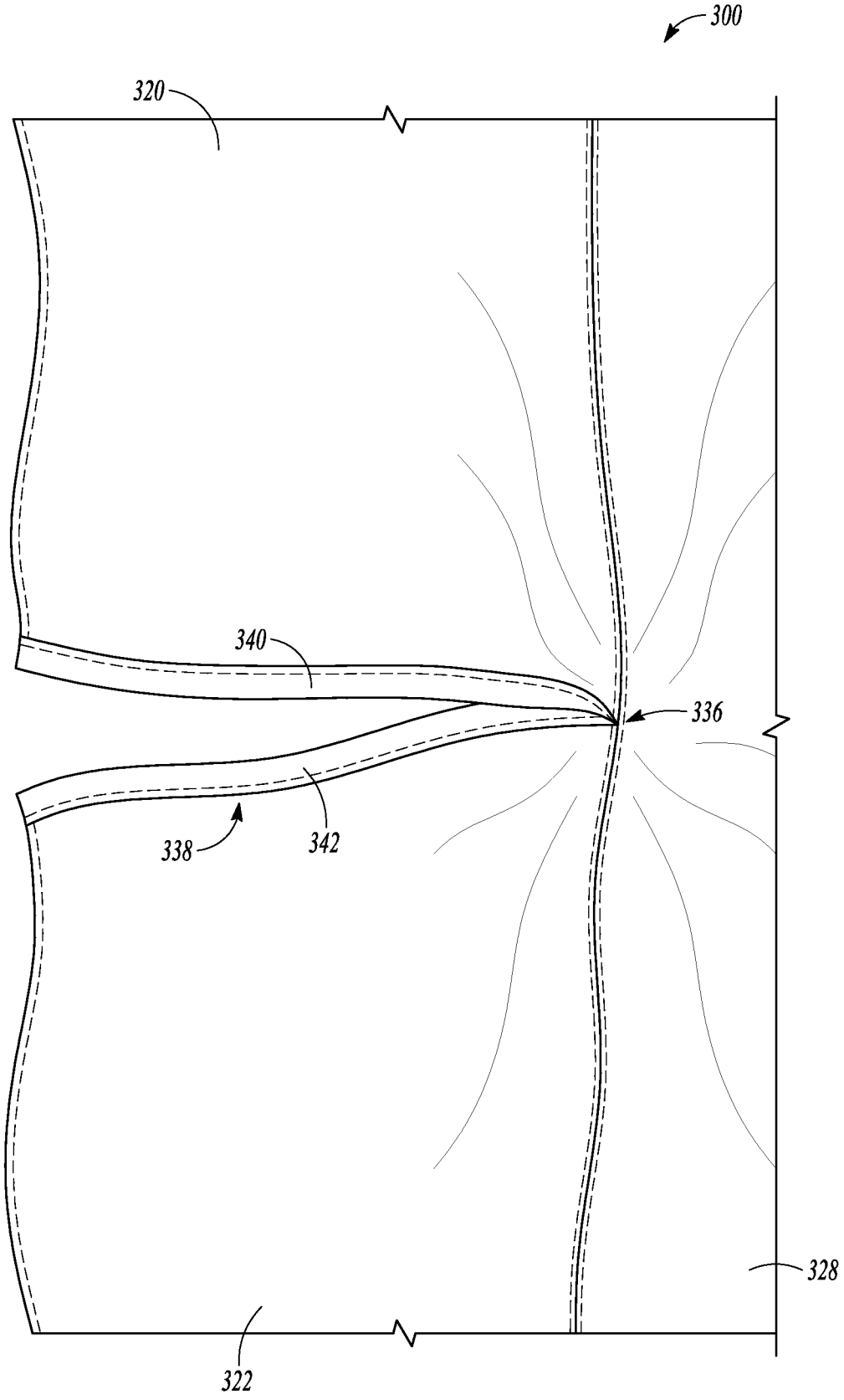
FIG. 15 is a close-up top view of the example sheet of FIG. 14.

FIGS. 14-16 show an example of a sheet 300 that can be used with a split-top mattress, such as the split head mattress 18 shown in FIG. 1 or the split head and split foot mattress 158 shown in FIG. 8. The sheet 300 is shown as being designed for a split-head and split-foot mattress 302, similar to the mattress 158 described above with respect to the sleep system 150, 210 of FIGS. 8-12. However, a similar sheet design could be used for a split-head only mattress similar to the mattress 18 described above with respect to the sleep system 10, 70, 80 of FIGS. 1-7.

FIG. 14 shows an exploded view of the sheet 300 and the mattress 302, e.g., with the sheet 300 and the mattress 302 being separated, e.g., before the sheet 300 has been placed onto the mattress 302, to better show separate aspects of the sheet 300 and the mattress 302. The sheet 300 can be configured to substantially cover the top surface and sides surfaces of the mattress 302. The mattress 302 can have a first articulable upper section 304 (referred to herein as a first head section 304), a separate second articulable upper section 306 (referred to herein as a second head section 306), a first articulable lower section 308 (referred to herein as a first leg section 308), a separate second articulable lower section 310 (referred to herein as a second leg section 310), and a joined middle section 312. As shown in FIG. 14, the first head section 304 and the second head section 306 can be pivotally coupled to the joined middle section 312, e.g., so that the first head section 304 can be pivoted up and down relative to the middle section 312 adjacent to where the second head section 306 can also be pivoted up and down relative to the middle section 312. Similarly, the first leg section 308 and the second leg section 310 can be pivotally coupled to the joined middle section 312, e.g., so that the first leg section 308 can be pivoted up and down relative to the middle section 312 adjacent to where the second leg section 310 can also be pivoted up and down relative to the middle section 312. In this way, the example mattress 302 shown in FIG. 14 is substantially the same as the split-head and split-leg mattress 158 of the sleep system 150 of FIG. 8. However, the mattress 302 can have other configurations, such as the split head and joined leg mattress 18 of the sleep system 10 of FIG. 1.

The mattress 302 can include a top surface 314 that is configured to support occupants of the mattress 302, a bottom surface 316, and one or more side surfaces 318 that extending between the top surface 314 and the bottom surface 316. The top surface 314, bottom surface 316, and the side surfaces 318 can be shaped and configured so that the mattress 302 forms the articulable sections of the adjustable bed, for example the first head section 304, the second head section 306, the first leg section 308, the second leg section 310, and the joined middle section 312.

The sheet 300 can have a shape that corresponds to the mattress 302 for which the sheet 300 is configured to cover. For example, the sheet 300 that is configured to cover the example mattress 302 shown in FIG. 14 has a first upper section 320 that corresponds to the first head section 304 of the mattress 302, a separate second upper section 322 that corresponds to the second head section 306 of the mattress 302, a first lower section 324 that corresponds to the first leg section 308 of the mattress 302, a separate second lower section 326 that corresponds to the second leg section 310 of the mattress 302, and a joined middle section 328 that corresponds to the joined middle section 312 of the mattress 302. The sheet 300 can be configured so that each section 320, 322, 324, 326, 328 can be dimensioned to fit snuggly over each corresponding section 304, 306, 208, 310, 312 of the mattress 302.

The sheet 300 can be formed from a top member 330, e.g., a top fabric sheet 330, that is configured to cover the top surface 314 of the mattress 302 and one or more side members 332, e.g., one or more side fabric sheets 332, that are coupled to the top member 330 and are configured to cover the one or more side surfaces 318 of the mattress 302. The one or more side fabric sheets 332 can also include a bottom portion 334 that is configured to wrap around at least a portion of the bottom surface 316 of the mattress 302, such as with elastic to form a snug fit of the bottom portion 334 onto the bottom surface 316 of the mattress 302.

The sheet 300 can also include one or more features that can provide for better durability of the sheet 300 on an adjustable split-top mattress 302, and/or can provide for a better fit of the sheet 300 onto the mattress 302, and/or can provide for better performance of the sheet 300 during articulation of the mattress 302.

For example, the motion of the mattress 302 during articulation can result in increased stress on the sheet 300, such as when a first movable section of the mattress 302 is articulated while an adjacent second movable section of the mattress 302 does not move with the first movable section, e.g., by moving to a different position or by remaining stationary. For example, if the first head section 304 remains lowered while the second head section 306 is raised, as shown in FIG. 14, the second upper section 322 of the sheet 300 can become stretched relative to the first upper section 320, and in particular can put added stress on a junction 336 between the first upper section 320, the second upper section 322, and the joined middle section 328 of the sheet 300. The junction 336 can be a point on the sheet 300 where several pieces of fabric and several seams come together, which can result in the sheet 300 being structurally weaker at the junction 336 than at other positions of the sheet 300. The junction 336 can also being a point where stress from the motion of the articulable sections 304, 306, 208, 310 of the mattress 302 can be larger. The combination of the structural weakness of the sheet 300 at the junction 336 and the increased stress exerted on the sheet 300 at the junction 336 can mean that the sheet can be particularly susceptible to damage (e.g., tearing, fraying, etc.) at the junction 336.

FIG. 15 shows a close up view of the junction 336 for the example sheet 300. The sheet 300 can be configured to reduce the stress experienced by the sheet 300 at the junction due to the motion of articulable sections 304,306, 308, 310 of the mattress 302. In an example, the sheet 300 can include one or more structures that are configured to distribute the stress on the sheet 300 so that it is not concentrated at any one point, particularly at the junction 336. The sheet 300 can include what is referred to herein as a "crossover joint." A crossover joint can comprise a first member projecting laterally from a first one of adjacent articulable sections of the sheet 300 toward the other articulable section of the sheet 300, and a second member projecting laterally from a second one of the adjacent articulable sections of the sheet 300 toward the other articulable section of the sheet 300. The first member can overlays, or cross over the second member along a predetermined length of the adjacent articulable sections extending from the junction of the sheet 300.

For example, at the junction 336 between the first upper section 320, the second upper section 322, and the joined middle section 328, a first crossover joint 338 can be formed comprising a first member 340 projecting laterally from the first upper section 320 and overlapping a second member 342 projecting laterally from the second upper section 322 (best seen in FIG. 15). As seen in FIG. 15, the members 340, 342 can each comprise a relatively thin strip of fabric, e.g., with a width $W_s$ of from about 0.5 centimeter (about 0.2 inches) to about 7.5 cm (about 3 inches). The first member 340 and the second member 342 can each extend along a longitudinal length of the sections 320, 322 from which they project (e.g., left to right in FIG. 15) up to, and in some case, including the junction 336 between the sections 320, 322, 328.

The members 340, 342 can provide for distribution of the stress exerted on the sheet 300 when articulable sections 304, 306 of the mattress 302 are moved. For example, if the first head section 304 is moved upward relative to the second head section 306, such that the first upper section 320 of the sheet is also moved upward relative to the second upper section 322, then the first member 340 projecting from the first upper section 320 of the sheet 300 can be deflected downward and the second member 342 projecting from the second upper section 322 can be deflected upward. Similarly, if the second head section 306 is moved upward relative to the first head section 304 such that the second upper section 322 of the sheet 300 is moved upward relative to the first uppers section 320, then the second member 342 can be deflected upward and the first member 342 can be deflected downward.

The deflected members 340, 342 can be tensioned by the motion of the articulated first head section 304 so that stress exerted on the sheet 300 by the articulated first head section 304 can be distributed across the members 340, 342 rather than being concentrated at the junction 336. The overlapping material of the first member 340 crossing over the second member 342 at the junction 336 can also act to reinforce the sheet 300 at the junction 336 by placing two pieces of fabric at the junction 336 rather than just one. Also, any stitching that can be applied to secure the members 340, 342 together and to the rest of the sheet 300 can provide additional structural support to the sheet 300 at the junction 336.

Because of the close proximity of the adjacent articulable sections 304, 306 of the mattress 302, a sheet on the mattress 302 can become bunched together or can ride up on the mattress 302, e.g., because the motion of the articulable sections 304, 306 relative to each other can cause the sheet to be moved up the mattress 302. In an example, the sheet 300 can include one or more features to prevent or mitigate bunching or riding up of the sheet 300 during articulation of the articulable sections 304, 306 of the mattress 302.

In an example, the sheet 300 can include friction-reducing panels 350A, 350B (referred to collectively herein as "friction-reducing panels 350" or "friction-reducing panel 350") at positions where one portion of the sheet 300 will be in contact with and sliding along another portion of the sheet 300, such as on adjacent and opposing side surfaces 318 of the mattress 302. For example, as shown in FIG. 14, the mattress 302 can include adjacent interior side surfaces 318A and 318B on lateral interior sides of the first articulable section 304 and the second articulable section 306, respectively. The sheet 300 can include corresponding friction-reducing panels 350A and 350B that are configured to cover the interior side surfaces 318A and 318B, respectively. The friction-reducing panels 350A, 350B can comprise one or more friction-reducing materials so that the friction-reducing panels 350A, 350B can slide freely or relatively freely over one another when the articulable sections 304, 306 are moved relative to each other. Examples of materials that can be used to some or a portion of the friction-reducing panels 350A, 350B include, but is not limited to, Lycra spandex fiber (e.g., a polyurethane-polyrea copolymer) and polytetrafluoroethylene (PTFE) fiber. The friction-reducing panels 350A, 350B can be made from the same material, wherein the material has a sufficiently low coefficient of friction with respect to itself, or the friction-reducing panels 350A, 350B can be made from different materials, where the coefficient of friction of the material of the first friction-reducing panel 350A on the material of the second friction-reducing panel 350B is sufficiently low.

The friction-reducing panels 350A, 350B can provide for a coefficient of friction between the panels 350A,350B that is sufficiently low so as to avoid deformation of the sheet 300 or to prevent or reduce the sheet 300 being pushed off the mattress 302 when adjacent articulable sections 304 and 306 or 308 and 310 are moved relative to one another.

To better illustrate the present sleep system of the present disclosure, a non-limiting list of Examples is provided here:

Example 1 can include subject matter (such as an apparatus, a device, a method, or one or more means for performing acts), such as can include a sleep system. The subject matter can comprise a mattress including a first sleep area for a first occupant, the first sleep area comprising a first movable upper section and a first movable lower section, and a second sleep area for a second occupant, the second sleep area comprising a second movable upper section adjacent to the first movable upper section and a second movable lower section adjacent to the first lower section. The first movable upper section is separate from and movable with respect to the second movable upper section. The first movable lower section and the second movable lower section are coupled together and move together. The sleep system can further include an articulation system for articulating the first movable upper section, the first movable lower section, the second movable upper section, and the second movable lower section, wherein the articulation system is configured to allow for independent movement of the first upper movable section and the second upper movable section and for substantially synchronized movement of the first lower movable section and the second lower movable section.

Example 2 can include, or can optionally be combined with the subject matter of example 1, to optionally include the articulation system comprising a first actuator for articulating the first movable upper section, a second actuator for articulating the second movable upper section, one or more third actuators for articulating the first movable lower section and the second movable lower section, and one or more controllers for controlling movement of the first actuator, the second actuator, and the one or more third actuators.

Example 3 can include, or can optionally be combined with the subject matter of one or any combination of examples 1 and 2, to optionally include the articulation system comprising a first actuator configured to articulate the first movable lower section, a second actuator configured to articulate the second movable lower section, and a controller configured to send one or more first motion control signals to the first actuator and one or more second motion control signals to the second actuator, wherein the first actuator control signals and the second actuator control signals are configured so that the first actuator and the second actuator operate in a substantially synchronized manner.

Example 4 can include, or can optionally be combined with the subject matter of one or any combination of examples 1-3, to optionally include a first user controlling device configured to communicate with the articulation system in order to control articulation of the first movable upper section.

Example 5 can include, or can optionally be combined with the subject matter of one or any combination of examples 1-4, to optionally include a second user controlling device configured to communicate with the articulation system in order to control articulation of the second movable upper section.

Example 6 can include, or can optionally be combined with the subject matter of one or any combination of examples 1-5, to optionally include the first user controlling device being configured to control articulation of the substantially synchronized movement of the first movable lower section and the second movable lower section.

Example 7 can include, or can optionally be combined with the subject matter of one or any combination of examples 1-6, to optionally include the second user controlling device being configured to control articulation of the substantially synchronized movement of the first movable lower section and the second movable lower section.

Example 8 can include, or can optionally be combined with the subject matter of one or any combination of examples 1-7, to optionally include one or more first supporting structures within the first sleep area for providing support to the first occupant.

Example 9 can include, or can optionally be combined with the subject matter of one or any combination of examples 1-8, to optionally include a first portion of the one or more first supporting structures being contained in the first movable upper section.

Example 10 can include, or can optionally be combined with the subject matter of one or any combination of examples 1-9, to optionally include a second portion of the one or more first supporting structures being contained in the first movable lower section.

Example 11 can include, or can optionally be combined with the subject matter of one or any combination of examples 1-10, to optionally include one or more second supporting structures within the second sleep area for providing support to the second occupant.

Example 12 can include, or can optionally be combined with the subject matter of one or any combination of examples 1-11, to optionally include a first portion of the one or more second supporting structures being contained in the second movable upper section.

Example 13 can include, or can optionally be combined with the subject matter of one or any combination of examples 1-12, to optionally include a second portion of the one or more second supporting structures being contained in the second movable lower section.

Example 14 can include, or can optionally be combined with the subject matter of one or any combination of examples 1-13, to optionally include the one or more first supporting structures comprising one or more air chambers.

Example 15 can include, or can optionally be combined with the subject matter of one or any combination of examples 1-14, to optionally include the one or more first supporting structures comprising a plurality of innersprings.

Example 16 can include, or can optionally be combined with the subject matter of one or any combination of examples 1-15, to optionally include the one or more first supporting structures comprising one or more foam structures.

Example 17 can include, or can optionally be combined with the subject matter of one or any combination of examples 1-16, to optionally include the one or more second supporting structures comprising one or more air chambers.

Example 18 can include, or can optionally be combined with the subject matter of one or any combination of examples 1-17, to optionally include the one or more second supporting structures comprising a plurality of innersprings.

Example 19 can include, or can optionally be combined with the subject matter of one or any combination of examples 1-18, to optionally include the one or more second supporting structures comprising one or more foam structures.

Example 20 can include, or can optionally be combined with the subject matter of one or any combination of examples 1-19, to include subject matter (such as an apparatus, a device, a method, or one or more means for performing acts), such as can include a sleep system. The subject matter can comprise a mattress including a movable first section extending laterally along a first portion of a width of the mattress and extending longitudinally along a first portion of a length of the mattress, a movable second section extending laterally along a second portion of the width of the mattress and extending longitudinally along the first portion of the length of the mattress, and a movable third section extending laterally across substantially the entire width of the mattress and extending longitudinally along a second portion of the length of the mattress. The sleep system can also include an articulation system configured to independently articulate the first section, the second section, and the third section.

Example 21 can include, or can optionally be combined with the subject matter of one or any combination of examples 1-20, to optionally include the articulation system comprising a first actuator for articulating the movable first section, a second actuator for articulating the movable second section, one or more third actuators for articulating the movable third section, and one or more controllers for controlling movement of the first actuator, the second actuator, and the one or more third actuators.

Example 22 can include, or can optionally be combined with the subject matter of one or any combination of examples 1-21, to optionally include the articulation system comprising a first actuator positioned on a first lateral side of the mattress, a second actuator positioned on a second lateral side of the mattress, wherein the first actuator and the second actuator cooperate to articulate the movable third section, and a controller configured to send one or more first motion control signals to the first actuator and one or more second motion control signals to the second actuator, wherein the first actuator control signals and the second actuator control signals are configured so that the first actuator and the second actuator operate in a substantially synchronized manner.

Example 23 can include, or can optionally be combined with the subject matter of one or any combination of examples 1-2, to optionally include a first user controlling device configured to communicate with the articulation system in order to control articulation of the movable first section.

Example 24 can include, or can optionally be combined with the subject matter of one or any combination of examples 1-23, to optionally include the first user controlling device being configured to control articulation of the movable third section.

Example 25 can include, or can optionally be combined with the subject matter of one or any combination of examples 1-24, to optionally include a second user controlling device configured to communicate with the articulation system in order to control articulation of the movable second section.

Example 26 can include, or can optionally be combined with the subject matter of one or any combination of examples 1-25, to optionally include the second user controlling device being configured to control articulation of the movable third section Example 27 can include, or can optionally be combined with the subject matter of one or any combination of examples 1-26, to optionally include one or more first supporting structures contained within the movable first section and a first portion of the movable third section.

Example 28 can include, or can optionally be combined with the subject matter of one or any combination of examples 1-27, to optionally include one or more second supporting structures within the movable second section and a second portion of the movable third section.

Example 29 can include, or can optionally be combined with the subject matter of one or any combination of examples 1-28, to optionally include the one or more first supporting structures comprising one or more air chambers.

Example 30 can include, or can optionally be combined with the subject matter of one or any combination of examples 1-29, to optionally include the one or more first supporting structures comprising a plurality of innersprings.

Example 31 can include, or can optionally be combined with the subject matter of one or any combination of examples 1-30, to optionally include the one or more first supporting structures comprising one or more foam structures.

Example 32 can include, or can optionally be combined with the subject matter of one or any combination of examples 1-31, to optionally include the one or more second supporting structures comprising one or more air chambers.

Example 33 can include, or can optionally be combined with the subject matter of one or any combination of examples 1-32, to optionally include the one or more second supporting structures comprising a plurality of innersprings.

Example 34 can include, or can optionally be combined with the subject matter of one or any combination of examples 1-33, to optionally include the one or more second supporting structures comprising one or more foam structures.

Example 35 can include, or can optionally be combined with the subject matter of one or any combination of examples 1-34, to optionally include a fourth section extending laterally across the entire width of the mattress and extending longitudinally along a third portion of the length of the mattress, wherein the third portion of the length is longitudinally between the first portion of the length and the second portion of the length.

Example 36 can include, or can optionally be combined with the subject matter of one or any combination of examples 1-35, to include subject matter (such as an apparatus, a device, a method, or one or more means for performing acts), such as can include a sleep system. The subject matter can include a support frame and a mattress configured to be positioned on the support frame. The mattress can include a movable first head section extending along a first portion of a length of the mattress, a movable second head section laterally adjacent to the movable first section and extending longitudinally along the first portion of the length of the mattress, and a movable leg section extending longitudinally along a second portion of the length of the mattress. A first sleep area for a first occupant can comprise the movable first head section and a first portion of the movable leg section. A second sleep area for a second occupant can comprise the movable second head section and a second portion of the movable leg section. The sleep system can also comprise an articulation system including a first head actuator for articulating the movable first head section, a second head actuator for articulating the movable second head section, at least one leg actuator for articulating the movable leg section, and at least one controller for controlling the first head actuator, the second head actuator, and the at least one leg actuator. The sleep system can further include a first user controlling device configured to communicate with the at least one controller via a first communication link in order to control articulation of the movable first head section and to control articulation of the movable leg section, and a second user controlling device configured to communicate with the at least one controller via a second communication link in order to control articulation of the movable second head section and to control articulation of the movable leg section.

Example 37 can include, or can optionally be combined with the subject matter of one or any combination of examples 1-36, to include subject matter (such as an apparatus, a device, a method, or one or more means for performing acts), such as can include a method for controlling an articulating bed. The subject matter can include:

sending a first movement control signal from a first user controlling device to one or more controllers, wherein the first movement control signal comprises one or more commands to move a movable first section of a mattress to a selected one of a plurality of positions, wherein the movable first section laterally extends across a first portion of a width of the mattress and longitudinally extends along a first portion of a length of the mattress;

sending a first actuator control signal, triggered by the first movement control signal, from the one or more controllers to a first articulating actuator;

moving the first movable section to the selected one of the plurality of positions of the first movable section according to the first actuator control signal with the first articulating actuator;

sending a second movement control signal from a second user controlling device to the one or more controllers, wherein the second movement control signal comprises one or more commands to move a second movable section of the mattress to a selected one of a plurality of positions of the second movable section, wherein the second movable section is laterally adjacent to the first movable section and laterally extends across a second portion of the width of the mattress and longitudinally extends along the first portion of the length of the mattress;

sending a second actuator control signal, triggered by the second movement control signal, from the one or more controllers to a second articulating actuator;

moving the second movable section to the selected one of the plurality of positions of the second movable section according to the second actuator control signal with the second articulating actuator;

sending a third movement control signal from one of the first user controlling device and the second user controlling device to the one or more controllers, wherein the third movement control signal comprises one or more commands to move a third movable section of the mattress to a selected one of a plurality of positions, wherein the third movable section longitudinally extends along a second portion of the length of the mattress;

sending a third actuator control signal, triggered by the third movement control signal, from the one or more controllers to a third articulating actuator configured to exert force at a first position of the movable third section;

sending a fourth actuator control signal, triggered by the third movement control signal, from the one or more controllers to a fourth articulating actuator configured to exert force at a second position of the movable third section; and moving the third movable section to the selected one of the plurality of positions, wherein the third actuator control signal and the fourth actuator control signal are configured so that movement of the third articulating actuator and movement of the fourth articulating actuator are substantially synchronized so that movement of the third movable section is substantially uniform across the width of the mattress.

Example 38 can include, or can optionally be combined with the subject matter of one or any combination of examples 1-37, to include subject matter (such as an apparatus, a device, a method, or one or more means for performing acts), such as can include a sleep system comprising an air posturizing module having an outer module case, the case comprising a first case section extending medially along a length of the outer module case to define a movable first posturing section, a second case section adjacent to the first case section and extending along a length of the outer module case to define a movable second posturing section, a third case section defining a third posturing section, a fourth case section extending medially along a length of the outer module case to define a movable third posturing section, a fifth case section extending medially along a length of the outer module case to define a movable fourth posturing section, one or more first air chambers carried in the first, third and fourth case sections to provide a first posturing sleep area, and one or more second air chambers carried in the second, third, and fifth module sections to provide a second posturing sleep area.

Example 39 can include, or can optionally be combined with the subject matter of one or any combination of examples 1-38, to optionally include a medial split between the movable first posturing section and the movable second posturing section.

Example 40 can include, or can optionally be combined with the subject matter of one or any combination of examples 1-39, to optionally include a second medial split between the movable third posturing section and the movable fourth posturing section.

Example 41 can include, or can optionally be combined with the subject matter of one or any combination of examples 1-40, to optionally include an inflation system configured to control the pressure within the one or more first air chambers.

Example 42 can include, or can optionally be combined with the subject matter of one or any combination of examples 1-41, to optionally include an inflation system configured to control the pressure within the one or more second air chambers.

Example 43 can include, or can optionally be combined with the subject matter of one or any combination of examples 1-42, to optionally include an articulation system configured to articulate the movable first posturing section, the movable second posturing section, the movable third posturing section and the movable fourth posturing section.

Example 44 can include, or can optionally be combined with the subject matter of one or any combination of examples 1-43, to optionally include the articulation system comprising one or more actuators configured to articulate one or more of the movable first posturing section, the movable second posturing section, the movable third posturing section, and the movable fourth posturing section.

Example 45 can include, or can optionally be combined with the subject matter of one or any combination of examples 1-33, to optionally include the articulation system comprising one or more controllers configured to control movement of the one or more actuators.

Example 46 can include, or can optionally be combined with the subject matter of one or any combination of examples 1-45, to optionally include the one or more actuators comprising an actuator for articulating the movable first posturing section.

Example 47 can include, or can optionally be combined with the subject matter of one or any combination of examples 1-46, to optionally include the one or more actuators comprising an actuator for articulating the movable second posturing section.

Example 48 can include, or can optionally be combined with the subject matter of one or any combination of examples 1-47, to optionally include the one or more actuators comprising an actuator for articulating the movable third posturing section.

Example 49 can include, or can optionally be combined with the subject matter of one or any combination of examples 1-48, to optionally include the one or more actuators comprising an actuator for articulating the movable fourth posturing section.

Example 50 can include, or can optionally be combined with the subject matter of one or any combination of examples 1-49, to optionally include a user controlling device configured to communicate with the articulation system in order to control articulation of the movable first posturing section and the movable third posturing section.

Example 51 can include, or can optionally be combined with the subject matter of one or any combination of examples 1-50, to optionally include a user controlling device configured to communicate with the articulation system in order to control articulation of the movable second posturing section and the movable fourth posturing section.

Example 52 can include, or can optionally be combined with the subject matter of one or any combination of examples 1-51, to optionally include the one or more controllers comprising a controller configured to control articulation of the movable first posturing section and the movable second posturing section.

Example 53 can include, or can optionally be combined with the subject matter of one or any combination of examples 1-52, to optionally include the one or more controllers comprising a controller configured to control articulation of the movable third posturing section and the movable fourth posturing section.

Example 54 can include, or can optionally be combined with the subject matter of one or any combination of examples 1-53, to optionally include the one or more controllers comprising a first controller configured to control articulation of the movable first posturing section and the movable second posturing section, and a second controller configured to control articulation of the movable third posturing section and the movable fourth posturing section.

Example 55 can include, or can optionally be combined with the subject matter of one or any combination of examples 1-54, to optionally include the one or more controllers comprising a controller configured to control articulation of the movable first posturing section and the movable third posturing section.

Example 56 can include, or can optionally be combined with the subject matter of one or any combination of examples 1-55, to optionally include the one or more controllers comprising a controller configured to control articulation of the movable second posturing section and the movable fourth posturing section.

Example 57 can include, or can optionally be combined with the subject matter of one or any combination of examples 1-56, to optionally include the one or more controllers comprising a first controller configured to control articulation of the movable first posturing section and the movable third posturing section, and a second controller configured to control articulation of the movable second posturing section and the movable fourth posturing section.

Example 58 can include, or can optionally be combined with the subject matter of one or any combination of examples 1-57, to optionally include an inflation system configured to control the pressure within the one or more first air chambers and the one or more second air chambers.

Example 59 can include, or can optionally be combined with the subject matter of one or any combination of examples 1-58, to optionally include the inflation system comprising one or more pumps.

Example 60 can include, or can optionally be combined with the subject matter of one or any combination of examples 1-59, to optionally include the one or more controllers of the articulation system being configured to control the one or more pumps of the inflation system.

Example 61 can include, or can optionally be combined with the subject matter of one or any combination of examples 1-60, to include subject matter (such as an apparatus, a device, a method, or one or more means for performing acts), such as can include a sleep system. The subject matter can include a mattress comprising a first sleep area for a first occupant, the first sleep area comprising a first movable upper section and a first movable lower section. The mattress can also include a second sleep area for a second occupant, the second sleep area comprising a second movable upper section adjacent to the first movable upper section and a second movable lower section adjacent to the first lower section. The mattress can further include a common middle section extending between the first sleep area and the second sleep area, the common middle section being positioned between the movable upper section and the movable lower section of each of the first sleep area and the second sleep area. The mattress can include one or more first air chambers carried by the first movable upper section, the first movable lower section, and a first portion of the common middle section. The mattress can also include one or more second air chambers carried by the second movable upper section, the second movable lower section and a second portion of the common middle section. The sleep system can also include an articulation system for articulating the first movable upper section, the first movable lower section, the second movable upper section, and the second movable lower section.

Example 62 can include, or can optionally be combined with the subject matter of one or any combination of examples 1-61, to optionally include the mattress further comprising a medial split between the first movable upper section and the second movable upper section.

Example 63 can include, or can optionally be combined with the subject matter of one or any combination of examples 1-62, to optionally include the mattress further comprising a medial split between the first movable lower section and the second movable lower section.

Example 64 can include, or can optionally be combined with the subject matter of one or any combination of examples 1-63, to optionally include an inflation system configured to control the pressure within the one or more first air chambers.

Example 65 can include, or can optionally be combined with the subject matter of one or any combination of examples 1-64, to optionally include an inflation system configured to control the pressure within the one or more second air chambers.

Example 66 can include, or can optionally be combined with the subject matter of one or any combination of examples 1-65, to optionally include an inflation system configured to control the pressure within the one or more first air chambers and the one or more second air chambers.

Example 67 can include, or can optionally be combined with the subject matter of one or any combination of examples 1-66, to optionally include the articulation system comprising one or more actuators configured to articulate one or more of the first movable upper section, the second movable upper section, the first movable lower section, and the second movable lower section.

Example 68 can include, or can optionally be combined with the subject matter of one or any combination of examples 1-67, to optionally include one or more controllers configured to control movement of the one or more actuators.

Example 69 can include, or can optionally be combined with the subject matter of one or any combination of examples 1-68, to optionally include the one or more actuators comprising a first actuator for articulating the first movable upper section, a second actuator for articulating the second movable upper section, a third actuator for articulating the first movable lower section, and a fourth actuator for articulating the second movable lower section.

Example 70 can include, or can optionally be combined with the subject matter of one or any combination of examples 1-69, to optionally include the one or more controllers comprising a controller configured to control articulation of the first movable upper section and the second movable upper section.

Example 71 can include, or can optionally be combined with the subject matter of one or any combination of examples 1-70, to optionally include the one or more controller comprising a controller configured to control articulation of the first movable lower section and the second movable lower section.

Example 72 can include, or can optionally be combined with the subject matter of one or any combination of examples 1-71, to optionally include the one or more controllers comprising a first controller configured to control articulation of the first movable upper section and the second movable upper section and a second controller configured to control articulation of the first movable lower section and the second movable lower section.

Example 73 can include, or can optionally be combined with the subject matter of one or any combination of examples 1-72, to optionally include the one or more controllers comprising a controller configured to control articulation of the first movable upper section and the first movable lower section.

Example 74 can include, or can optionally be combined with the subject matter of one or any combination of examples 1-73, to optionally include the one or more controllers comprising a controller configured to control articulation of the second movable upper section and the second movable lower section.

Example 75 can include, or can optionally be combined with the subject matter of one or any combination of examples 1-74, to optionally include the one or more controllers comprising a first controller configured to control articulation of the first movable upper section and the first movable lower section and a second controller configured to control articulation of the second movable upper section and the second movable lower section.

Example 76 can include, or can optionally be combined with the subject matter of one or any combination of examples 1-75, to optionally include an inflation system configured to control the pressure within the one or more first air chambers.

Example 77 can include, or can optionally be combined with the subject matter of one or any combination of examples 1-76, to optionally include an inflation system configured to control the pressure within the one or more second air chambers.

Example 78 can include, or can optionally be combined with the subject matter of one or any combination of examples 1-77, to optionally include an inflation system configured to control the pressure within the one or more first air chambers and the one or more second air chambers.

Example 79 can include, or can optionally be combined with the subject matter of one or any combination of examples 1-78, to optionally include the inflation system comprising one or more pumps.

Example 80 can include, or can optionally be combined with the subject matter of one or any combination of examples 1-79, to optionally include the one or more controllers of the articulation system being configured to control the one or more pumps of the inflation system.

Example 81 can include, or can optionally be combined with the subject matter of one or any combination of examples 1-80, to optionally include a user controlling device configured to communicate with the articulation system in order to control articulation of the first movable upper section and the first movable lower section.

Example 82 can include, or can optionally be combined with the subject matter of one or any combination of examples 1-81, to optionally include a user controlling device configured to communicate with the articulation system in order to control articulation of the second movable upper section and the second movable lower section.

Example 83 can include, or can optionally be combined with the subject matter of one or any combination of examples 1-82, to optionally include a first user controlling device configured to communicate with the articulation system in order to control articulation of first movable upper section and the first movable lower section and a second user controlling device configured to communicate with the articulation system in order to control articulation of the second movable upper section and the second movable lower section.

Example 84 can include, or can optionally be combined with the subject matter of one or any combination of examples 1-86, to include subject matter (such as an apparatus, a device, a method, or one or more means for performing acts), such as can include a sheet for covering at least a portion of a mattress that includes a movable first section and a movable second section that is laterally adjacent to and proximate to the movable first section. The subject matter can include a first sheet section configured to cover at least a portion of the movable first section of the mattress, a second sheet section laterally adjacent to the first sheet section, the second sheet section configured to cover at least a portion of the movable second section of the mattress, wherein the first sheet section and the second sheet section are joined together at a sheet junction. The sheet can further include a first member projecting laterally from the first sheet section toward the second sheet section, the first member extending up to the sheet junction and a second member projecting laterally from the second sheet section toward the first sheet section, the second member extending up to the sheet junction. At least a portion of the first member can overlay at least a portion of the second member proximate to the sheet junction.

Example 85 can include, or can optionally be combined with the subject matter of one or any combination of examples 1-84, to optionally include the mattress further comprising a joined section, wherein the movable first section and the movable second section are pivotally coupled to the joined section.

Example 86 can include, or can optionally be combined with the subject matter of one or any combination of examples 1-87, to optionally include the sheet further comprising a joined sheet section configured to cover the joined section, wherein the first sheet section, the second sheet section, and the joined sheet section meet at the sheet junction.

Example 87 can include, or can optionally be combined with the subject matter of one or any combination of examples 1-86, to optionally include the mattress further comprises a movable third section and a movable fourth section that is laterally adjacent to and proximate to the movable third section, wherein the movable third section and the movable fourth section are pivotally coupled to the joined section.

Example 88 can include, or can optionally be combined with the subject matter of one or any combination of examples 1-87, to optionally include the sheet further comprising a third sheet section configured to cover at least a portion of the movable third section of the mattress and a fourth sheet section laterally adjacent to the third sheet section, the fourth sheet section configured to cover at least a portion of the movable fourth section of the mattress, wherein the third sheet section, the fourth sheet section, and the joined sheet section meet at a second sheet junction.

Example 89 can include, or can optionally be combined with the subject matter of one or any combination of examples 1-18, to optionally include a third member projecting laterally from the third sheet section toward the fourth sheet section, the third member extending up to the second sheet junction.

Example 90 can include, or can optionally be combined with the subject matter of one or any combination of examples 1-89, to optionally include and a fourth member projecting laterally from the fourth sheet section toward the third sheet section, the fourth member extending up to the second sheet junction.

Example 91 can include, or can optionally be combined with the subject matter of one or any combination of examples 1-90, to optionally include at least a portion of the third member overlaying at least a portion of the fourth member proximate to the second sheet junction.

Example 92 can include, or can optionally be combined with the subject matter of one or any combination of examples 1-91, to optionally include the first sheet section comprising a first side panel configured to cover a first side surface of the movable first section of the mattress.

Example 93 can include, or can optionally be combined with the subject matter of one or any combination of examples 1-92, to optionally include the second sheet section comprises a second side panel configured to cover a second side surface of the movable second section of the mattress.

Example 94 can include, or can optionally be combined with the subject matter of one or any combination of examples 1-93, to optionally include the first side panel is proximate to or in contact with the second side panel when the sheet is covering the mattress.

Example 95 can include, or can optionally be combined with the subject matter of one or any combination of examples 1-94, to optionally include at least a portion of the first side panel comprising one or more reduced-friction materials.

Example 96 can include, or can optionally be combined with the subject matter of one or any combination of examples 1-95, to optionally include at least a portion of the second side panel comprising one or more reduced-friction materials.

Example 97 can include, or can optionally be combined with the subject matter of one or any combination of examples 1-96, to optionally include at least a portion of the first side panel and at least a portion of the second side panel comprise one or more reduced-friction materials.

Example 98 can include, or can optionally be combined with the subject matter of one or any combination of examples 1-97, to optionally include the one or more reduced-friction materials comprising a lycra spandex fiber.

Example 99 can include, or can optionally be combined with the subject matter of one or any combination of examples 1-98, to optionally include the one or more reduced-friction materials comprising a polytetrafluoroethylene fiber.

Example 100 can include, or can optionally be combined with the subject matter of one or any combination of examples 1-99, to include subject matter (such as an apparatus, a device, a method, or one or more means for performing acts), such as can include a sheet for covering at least a portion of a mattress that includes a movable first section and a movable second section that is laterally adjacent to and proximate to the movable first section. The subject matter can include a top member configured to cover a top surface of the mattress and one or more side members coupled to the top member, the one or more side members being configured to cover one or more side surfaces of the mattress. A first portion of a the one or more side members can be configured to cover a side surface of the movable first section that is adjacent to the second movable section. A second portion of the one or more side members can be configured to cover a side surface of the movable second section that is adjacent to the first movable section so that when the sheet is covering the mattress the first portion of the one or more side members is proximate to or in contact with the second portion of the one or more side members. The first portion of the one or more side members and the second portion of the one or more side members comprise one or more reduced-friction materials.

Example 101 can include, or can optionally be combined with the subject matter of one or any combination of examples 1-100, to optionally include the reduced-friction material comprising a lycra spandex fiber.

Example 102 can include, or can optionally be combined with the subject matter of one or any combination of examples 1-101, to optionally include the reduced-friction material comprising a polytetrafluoroethylene fiber.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented, at least in part. Some examples can include a computer-readable medium or machine-readable medium encoded with instructions operable to configure an electronic device to perform methods or method steps as described in the above examples. An implementation of such methods or method steps can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Although the invention has been described with reference to exemplary embodiments, workers skilled in the art will recognize that changes may be made in form and detail without departing from the spirit and scope of the invention.

What is claimed is:

1. A sleep system, comprising:

a mattress including:

a movable first section extending laterally along a first portion of a width of the mattress and extending longitudinally along a first portion of a length of the mattress;

a movable second section extending laterally along a second portion of the width of the mattress and extending longitudinally along the first portion of the length of the mattress; and a movable third section extending laterally across substantially the entire width of the mattress and extending longitudinally along a second portion of the length of the mattress; and an articulation system configured to independently articulate the first section, the second section, and the third section, wherein the articulation system comprises:

a first actuator positioned on a first lateral side of the mattress;

a second actuator positioned on a second lateral side of the mattress; and a single actuator controller configured to instruct both the first actuator and the second actuator to cooperatively articulate the movable third section by sending one or more first motion control signals to the first actuator and one or more second motion control signals to the second actuator via one or more physical communication links, wherein the first actuator control signals and the second actuator control signals are configured so that the first actuator and the second actuator operate in a substantially synchronized manner as the first and second actuators are raised from a first position to a second position and as the first and second actuators are lowered from the second position to the first position.

2. The sleep system according to claim 1, wherein the articulation system comprises:

the first actuator is configured for articulating the movable first section;

the second actuator is configured for articulating the movable second section;

one or more third actuators for articulating the movable third section; and the actuator controller for controlling movement of the first actuator, the second actuator, and the one or more third actuators.

3. The sleep system according to claim 1, further comprising a first user controlling device configured to communicate with the articulation system in order to control articulation of the movable first section and the movable third section.

4. The sleep system according to claim 3, further comprising a second user controlling device configured to communicate with the articulation system in order to control articulation of the movable second section.

5. The sleep system according to claim 4, wherein the second user controlling device is further configured to control articulation of the movable third section.

6. The sleep system of claim 1, further comprising a fourth section extending laterally across the entire width of the mattress and extending longitudinally along a third portion of the length of the mattress, wherein the third portion of the length is longitudinally between the first portion of the length and the second portion of the length.

7. The sleep system of claim 1, wherein the actuator controller synchronizes operation of the first and second actuators to cooperatively move the movable third section of the mattress as a function of feedback from first and second sensors.

8. The sleep system of claim 1, wherein the actuator controller produces one or more control signals comprising an instruction for a direction of movement and a speed for the movement of the first and second actuators.

9. The sleep system of claim 8, wherein the control signal controls a direction, speed, and duration of movement of one or more articulating motors for the first and second actuators.

10. The sleep system of claim 8, wherein the direction, speed, and duration of movement of the first and second actuators operate in a synchronized manner such that the substantially synchronized movable third section along the first and second lateral sides of the mattress moves in a substantially same amount over substantially the same period of time.

11. A sleep system, comprising:

a support frame;

a mattress configured to be positioned on the support frame, the mattress including;

a movable first head section extending along a first portion of a length of the mattress;

a movable second head section laterally adjacent to the movable first section and extending longitudinally along the first portion of the length of the mattress; and a movable leg section extending longitudinally along a second portion of the length of the mattress;

wherein a first sleep area for a first occupant comprises the movable first head section and a first portion of the movable leg section, and wherein a second sleep area for a second occupant comprises the movable second head section and a second portion of the movable leg section;

an articulation system including;

a first head actuator for articulating the movable first head section;

a second head actuator for articulating the movable second head section;

first and second leg actuators for articulating the first and second portions of the movable leg section, respectively, in a substantially synchronized manner, such that each point on the first portion of the movable leg section is substantially the same vertical position as a corresponding point on the second portion of the movable leg section at substantially the same time, so that the height of the first portion of the moveable leg section and the second portion of the movable leg section are substantially uniform as the first and second portions are raised and as the first and second portions are lowered; and a first actuator controller for controlling the first head actuator, the second head actuator, and the first and second leg actuators via one or more cable connections;

a first user controlling device configured to communicate with the first actuator controller via a first wireless communication link in order to control articulation of the movable first head section and to control articulation of the first and second portions of the movable leg section; and a second user controlling device configured to communicate with the first actuator controller via a second wireless communication link in order to control articulation of the movable second head section and to control articulation of the first and second portions of the movable leg section.

12. The sleep system of claim 11, wherein the first user controlling device is configured to send a first movement control signal comprising a first identifier that corresponds to the first user controlling device, and wherein the second user controlling device is configured to send a second movement control signal comprising a second identifier that corresponds to the second user controlling device, wherein the first and second identifiers identify which user controlling device is sending a movement control signal to the first actuator controller.

13. The sleep system of claim 11, wherein the first actuator controller comprises a processor and one or more communication modules, wherein the processor is configured to control the operation of the first actuator controller, wherein each communication module comprises a telemetry module and a communication bus, wherein the telemetry module comprises a radio frequency transceiver configured for bi-directional communication, and wherein the communication bus comprises a physical communication link to the first actuator controller and one or more ports addressed to correspond through the one or more cable connections to the first head actuator, the second head actuator, and the first and second leg actuators.

14. The sleep system of claim 13, wherein the first actuator controller directly communicates with the radio frequency transceiver.

* * * * *